US007004006B2

(12) United States Patent
Nagae

(10) Patent No.: US 7,004,006 B2
(45) Date of Patent: Feb. 28, 2006

(54) MOTOR DRIVEN LINK PRESS

(75) Inventor: Masayuki Nagae, Owariasahi (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 129 days.

(21) Appl. No.: 10/426,694

(22) Filed: May 1, 2003

(65) Prior Publication Data

US 2003/0205150 A1 Nov. 6, 2003

(30) Foreign Application Priority Data

May 1, 2002 (JP) ..... 2002-129562
May 1, 2002 (JP) ..... 2002-129563
May 1, 2002 (JP) ..... 2002-129564
May 1, 2002 (JP) ..... 2002-129565
May 1, 2002 (JP) ..... 2002-129566
May 1, 2002 (JP) ..... 2002-129615
May 1, 2002 (JP) ..... 2002-129616

(51) Int. Cl.
*B21J 9/18* (2006.01)
*B30B 1/06* (2006.01)

(52) U.S. Cl. ..... 72/450; 100/280; 83/602; 83/628

(58) Field of Classification Search ..... 100/280, 100/281, 282, 283; 74/40, 42, 45; 83/602, 83/628, 632, 684, 697, 698.11; 72/431, 450, 72/451, 452.5, 452.7; 425/451.5, 592
See application file for complete search history.

(56) References Cited

U.S. PATENT DOCUMENTS 3,772,986 A * 11/1973 Kawagoshi et al. ..... 100/282
5,762,480 A * 6/1998 Adahan ..... 417/415
5,921,125 A * 7/1999 Inoue et al. ..... 72/20.2
6,626,022 B1 * 9/2003 Stamm ..... 72/450

FOREIGN PATENT DOCUMENTS

DE 3736353 A1 * 5/1989
JP 63 10099 * 1/1988
JP 3-42159 6/1991
JP 10-109195 4/1998

OTHER PUBLICATIONS

Translation copy of JP 63-10099.*
Translation copy of DE 3736353 A1.*

* cited by examiner

*Primary Examiner*—Derris H. Banks
*Assistant Examiner*—Jimmy T. Nguyen
(74) *Attorney, Agent, or Firm*—Westerman, Hattori, Daniels & Adrian, LLP

(57) ABSTRACT

The present invention provides a motor driven link press which enables working with a heavy press load and also enables a working cycle time to be improved even when a motor with a relatively low output power is used and which can be properly controlled easily. A motor driven link press comprises a link mechanism 1 that converts a rotating operation into a linear operation and a ram 6 that elevates and lowers for press working on the basis of this linear operation. The link mechanism 1 comprises a crank member 2 having a crank shaft 3 and an eccentric shaft portion 4, a pivoting link 5, a connecting rod 7, and a restraining link 8. The pivoting link 5 has a first to third connecting portions P1 to P3 and is connected to the eccentric shaft portion 4 of the crank member 2 using the connecting portion P1. The connecting rod 7 is connected to the second connecting portion P2 and the ram 6. The restraining link 8 is rotationally removably supported on a frame 9 and is connected to the connecting portion P3 to restrain pivoting of the pivoting link 5. A drive transmitting system 14 is provided to transmit driving effected by a motor 13 to the crank shaft 3 of the link mechanism 1. The drive transmitting system can control rotation of the motor 13 to transmit driving effected by the motor 13 so that an elevating and lowering operations of the ram 6 can be controlled.

2 Claims, 30 Drawing Sheets

MOTOR DRIVEN LINK PRESS

FIELD OF THE INVENTION

The present invention relates to a motor driven link press applied to a punch press or another press machine.

BACKGROUND OF THE INVENTION

In mechanical punch presses, a crank mechanism is commonly used as a slide driving mechanism that converts a rotating operation of a motor into an elevating or lowering operation of a ram. Further, a flywheel is used, and a clutch is let in or released to rotate or stop the flywheel to drive or stop the ram. With the crank mechanism, curves for the elevating and lowering speeds of the ram are symmetric with respect to a bottom dead center. The lowering speed is thus the same as the elevating speed. However, for general press working including punch working, the ram preferably moves at lower speed during lowering in order to make the lowering operation silent or because of a requirement for a press load. However, the elevating operation is not particularly limited and is thus preferably faster. With a crank mechanism in which the lowering speed is the same as the elevating speed, it takes more time than required to achieve elevation. This increases a cycle time for punch working.

Recently, apparatuses have been proposed which use a servomotor as a driving source to elevate and lower the ram via a crank mechanism without using any flywheels. The servomotor can freely change the speed of the ram during its stroke and can increase its lowering speed while reducing its elevating speed. However, the capabilities of the motor depend on its rotation speed. The motor must be operated within the range of the optimum motor rotation speed according to the characteristics of the motor. If the rotation speed of the motor is controlled so that the lowering speed differs from the elevating speed, it is impossible to make full use of capabilities of the motor. A large-sized motor is required to increase the elevating speed while obtaining a required press load.

The applicant thus examined various slide mechanisms in order to select an appropriate slide mechanism that enables the ram to lower at a low speed while elevating at a high speed.

A link press has long been used as a slide mechanism used for a press device for plastic forming such as cold extrusion or upsetting of metal (for example, the Examined Japanese Patent Application Publication (Tokkou-Hei No. 3-42159). The link press comprises a pivoting link connected to a crank pin of a crank mechanism and to which a connecting rod and a restraining link are connected. The crank shaft is driven by a motor via a flywheel. With this link press, the restraining link serves to characterize the operation of the ram so that the ram lowers at a low speed and elevates fast.

However, the conventional link press is used to improve the quality of plastic forming such as cold extrusion by utilizing its very slow lowering operation performed near a bottom dead center. Thus, no conventional link presses have been applied to a punch press for which operational characteristics different from those for plastic forming are required. Further, the conventional link press is provided with a flywheel that stores output power from the motor as inertia energy. Consequently, it is difficult to properly control the conventional link press easily.

It is thus an object of the present invention to provide a motor driven link press which enables working with a heavy press load and also enables a working cycle time to be improved even when a motor with a relatively low output power is used and which can be properly controlled easily.

It is another object of the present invention to freely control an operation speed to accomplish various types of working while making use of advantages of the link press.

It is yet another object of the present invention to ensure punching scraps are dropped when the link press is applied to a punch press.

SUMMARY OF THE INVENTION

A motor driven link press according to the present invention a motor, a link mechanism that converts rotating operation transmitted by the motor via a drive transmitting system, into a linear operation, and a ram installed below the link mechanism to elevate and lower for press working on the basis of this linear operation. The link mechanism comprises a crank member having a crank shaft and an eccentric shaft portion, a pivoting link having a first to third connecting portions located at vertices of a triangle and which are used for rotatable connections, the first connecting portion being connected to the eccentric shaft portion of the crank member, a connecting rod having opposite ends connected to the second connecting portion and an upper end of the ram, respectively, and a restraining link having a proximal end rotationally movably connected to a frame and a leading end connected to the third connecting portion of the pivoting link, the restraining link restraining pivoting of the pivoting link so that a lowering operation of the ram is slower than an elevating operation of the ram when the crank shaft is rotated at a fixed speed in one direction. The drive transmitting system controls rotation of the motor to transmit rotational driving effected by the motor to the crank shaft so that an elevating and lowering operations of the ram can be controlled. The drive transmitting system includes no parts such as a flywheel which are intended to apply inertia. The drive transmitting system may have a speed reducer or an output shaft of the motor and the crank shaft may be directly coupled together.

The operation of this configuration will be described. The crank shaft is rotated to cause the pivoting link to perform a composite operation including a revolving operation along a turning locus of axis of the eccentric shaft portion and rotational motion in which the pivoting link pivots back and forth because the restraining link is connected to the pivoting link. The revolving operation of the pivoting link elevates or lowers the connecting rod connected to the pivoting link. However, the rotational motion hinders an elevating and lowering speed curve for the lower end position of the connecting rod, i.e. the ram position, from being quasi-sinusoidal. The curve for a lowering operation and the curve for an elevating operation are thus asymmetric. Which of the lowering and elevating operations is faster depends on a combination of various elements such as the support point position and length of the restraining link. Thus, these elements can be properly designed to allow the restraining link to regulate the pivoting of the pivoting link so that the lowering operation of the ram is slower than its elevating operation when the crank shaft is rotated at a fixed speed in one direction. By thus reducing the lowering speed, it is possible to accomplish working with a heavy press load and increase the lowering speed even when a motor with a relatively low output power is used. This improves a working cycle time. The above speed change can be accomplished with a fixed motor speed. Thus, for example, a speed reducer with an appropriate reduction ratio can be used to operate the motor with a motor rotation speed providing the maximum motor output power according to its characteristics. This also allows a motor with lower output power to be used. Further, the motor and the crank shaft are connected together via the drive transmitting system including no inertia applying systems such as a flywheel. Thus, for example, it is easy to provide such control as a change in ram speed based on, for example, the control of rotation speed of the motor.

If the above motor is a servomotor, the motor speed can be freely changed. Accordingly, the speed of the ram can be changed during its elevating and lowering stroke. This enables working according to various requirements. That is, a speed curve based on operations of a link mechanism composed of the crank mechanism, pivoting link, restraining link, and the like is used as a basic speed curve observed if the motor is rotated at a uniform speed, and the motor speed is varied. Then, for example, the speed at which the punch tool contacts with a workpiece can be reduced to make operations more silent. Alternatively, the elevating speed can be further increased.

The motor driven link press of the present invention may be a punch press. In this case, that section of elevating and lowering stroke of the ram which is used to punch a plate material workpiece is an intermediate section of lowering process of the elevating and lowering stroke. The section used for punching is determined by the relationship between the height of a table on which the plate material workpiece is placed and the ram position and the installation heights of a punch and a die tool, or the like.

If the intermediate section of elevating and lowering stroke of the ram is thus used as a punching section, a sufficient stroke can be provided below the bottom surface of the plate material workpiece. This ensures that punching scraps are dropped.

DETAILED DESCRIPTION OF THE PREFERRED EMBODIMENTS

Figure 1:
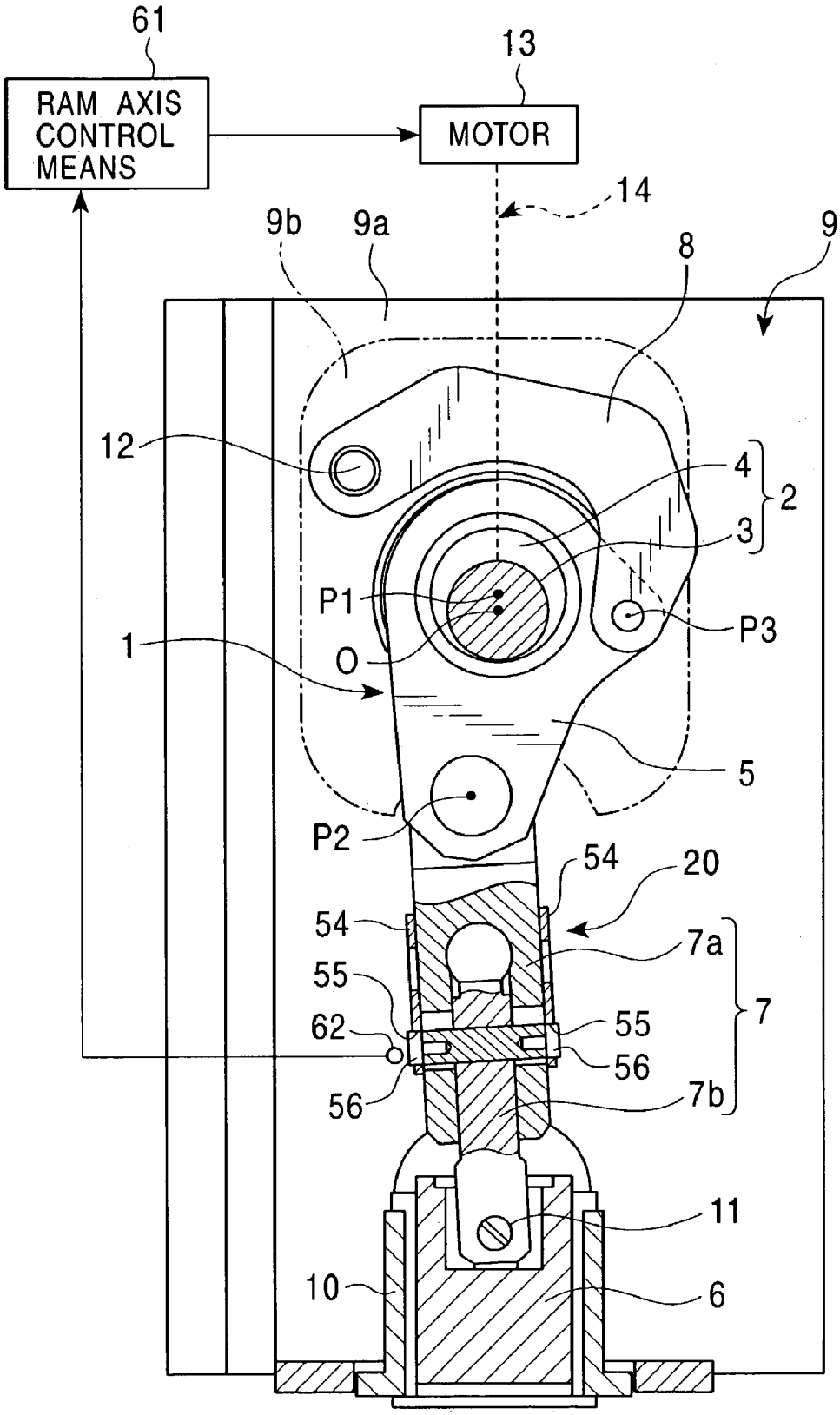
FIG. 1 is an exploded front view of a link mechanism in a motor driven link press according to an embodiment of the present invention.

Embodiments of the present invention will de described with reference to the drawings. FIG. 1 is an exploded front view of a link mechanism in a motor driven link press. This motor driven link press comprises a motor 13, a link mechanism 1 that converts rotating operation transmitted by the motor 13 via a drive transmitting system 14, into a linear operation, and a ram 6 installed below the link mechanism 1 to elevate and lower for press working on the basis of the linear operation. The link mechanism 1 comprises a crank member 2 having an eccentric shaft portion 4 that is eccentric to the axis of a crank shaft 3, a pivoting link 5 connected to the eccentric shaft portion 4, a connecting rod 7, and a restraining link 8. The crank shaft 3 is rotatably installed on a frame 9 and receives rotational driving force. The eccentric shaft portion 4 has a larger diameter than the crank shaft 3. Instead of having a large diameter such as the illustrated one, the eccentric shaft 4 may have a smaller diameter than the crank shaft 3 and may be integrated with the crank shaft 3 via a crank arm (not shown in the drawings). The ram 6 is a member that elevates and lowers a press work applying section such as a punch tool. The ram 6 is installed on the frame 9 so as to freely elevate and lower via a guide member 10. The ram 6 is located immediately below the crank shaft 2.

Figure 7:
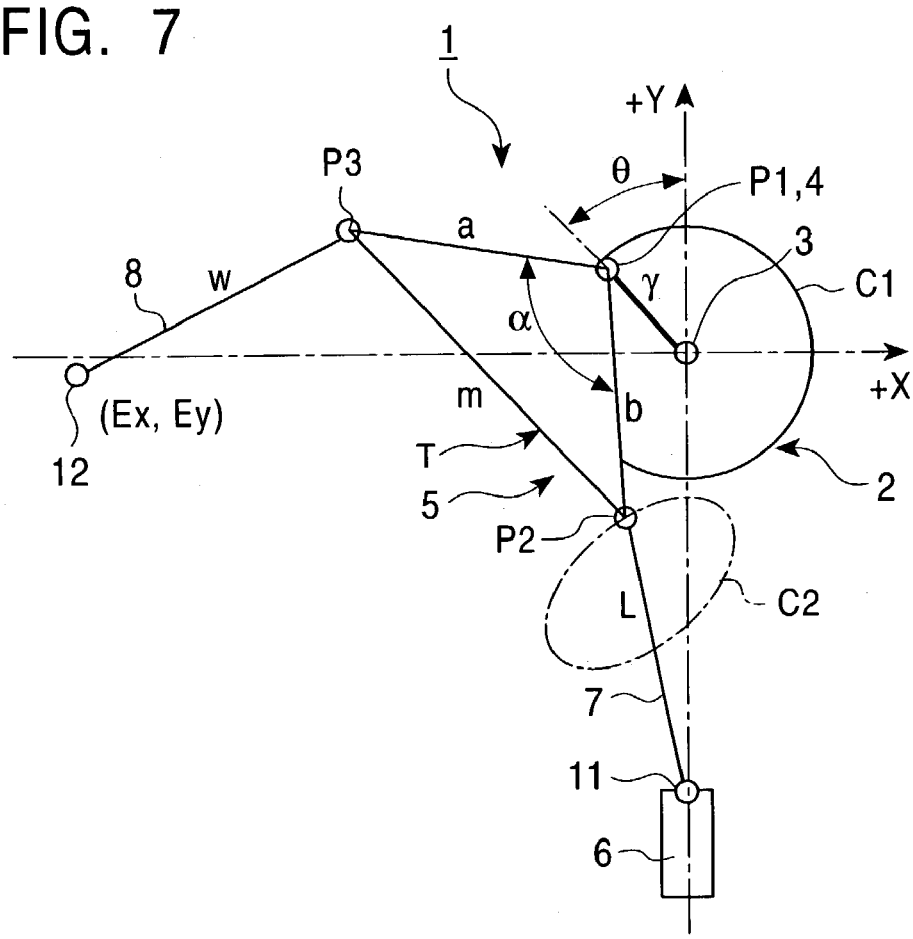
FIG. 7 is a diagram illustrating an operation model of this link mechanism.

The pivoting link 5 has a first to third connecting portions P1 to P3 and is connected to the eccentric shaft portion 4 of the crank member 2 via the first connecting portion P1. The connecting portions P1 to P3 allow the pivoting link 5 to be rotatably connected and are located at the respective vertices of a triangle T as schematically shown in FIG. 7. The triangle T is arbitrarily formed in a plane perpendicular to the axis of the crank shaft 3. In FIG. 1, the connecting rod 7 has an upper end connected to the second connecting portion P2 of the pivoting link 5 and a lower end rotatably connected to the upper end of the ram 6 via a pin 11. The restraining link 8 has a proximal end rotationally movably supported on the frame 9 via a support point shaft 12 and a leading end connected to the third connecting portion P3 of the pivoting link 5. In the restraining link 8, a pivoting center, i.e. the axis of the support point shaft 12, and the third connecting portion P3 are arranged at respective sides of the crank shaft 3. These sides are located in the plane perpendicular to the axis of the crank shaft 3 and may be arranged laterally or longitudinally with respect to the entire motor driven link press.

Figure 4:
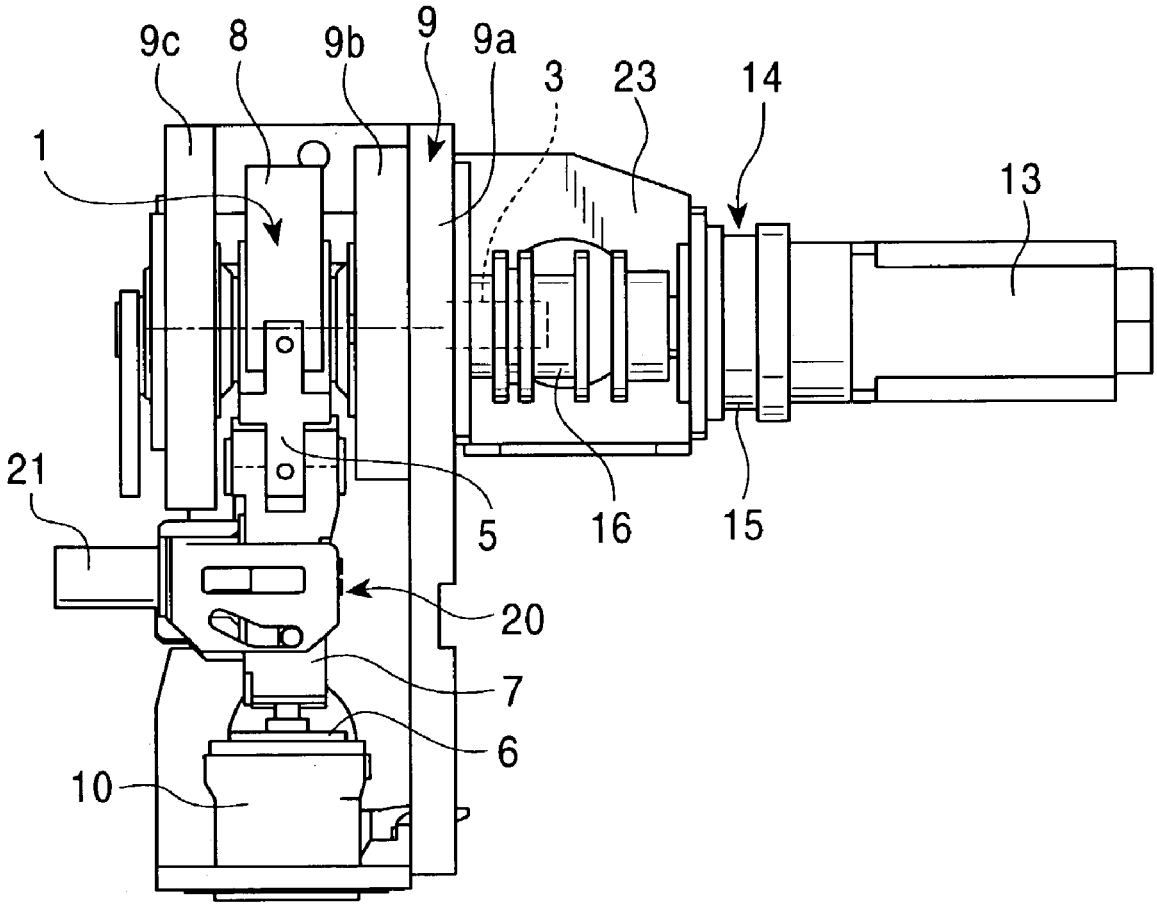
FIG. 4 is a side view showing this link mechanism and how it is connected.
Figure 5:
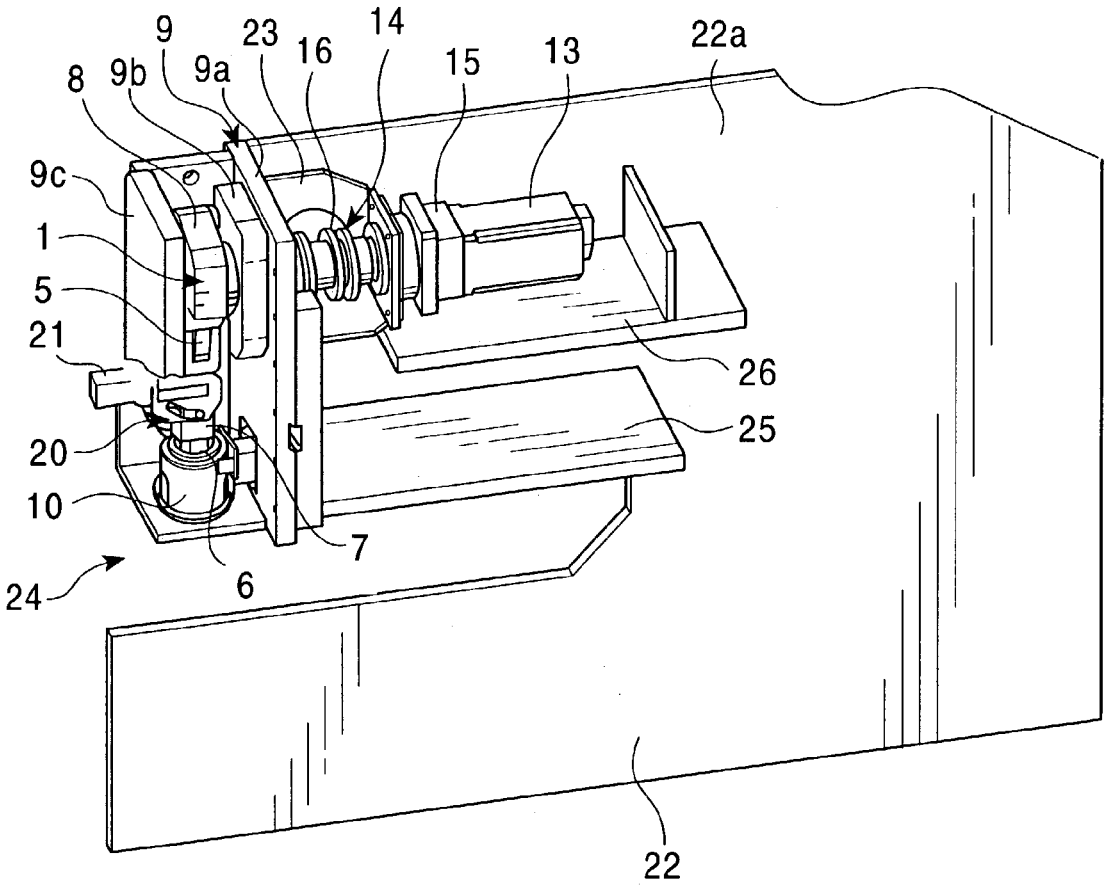
FIG. 5 is a perspective view showing a portion of the motor driven link press in which this link mechanism and a motor are installed on a main body frame.
Figure 6:
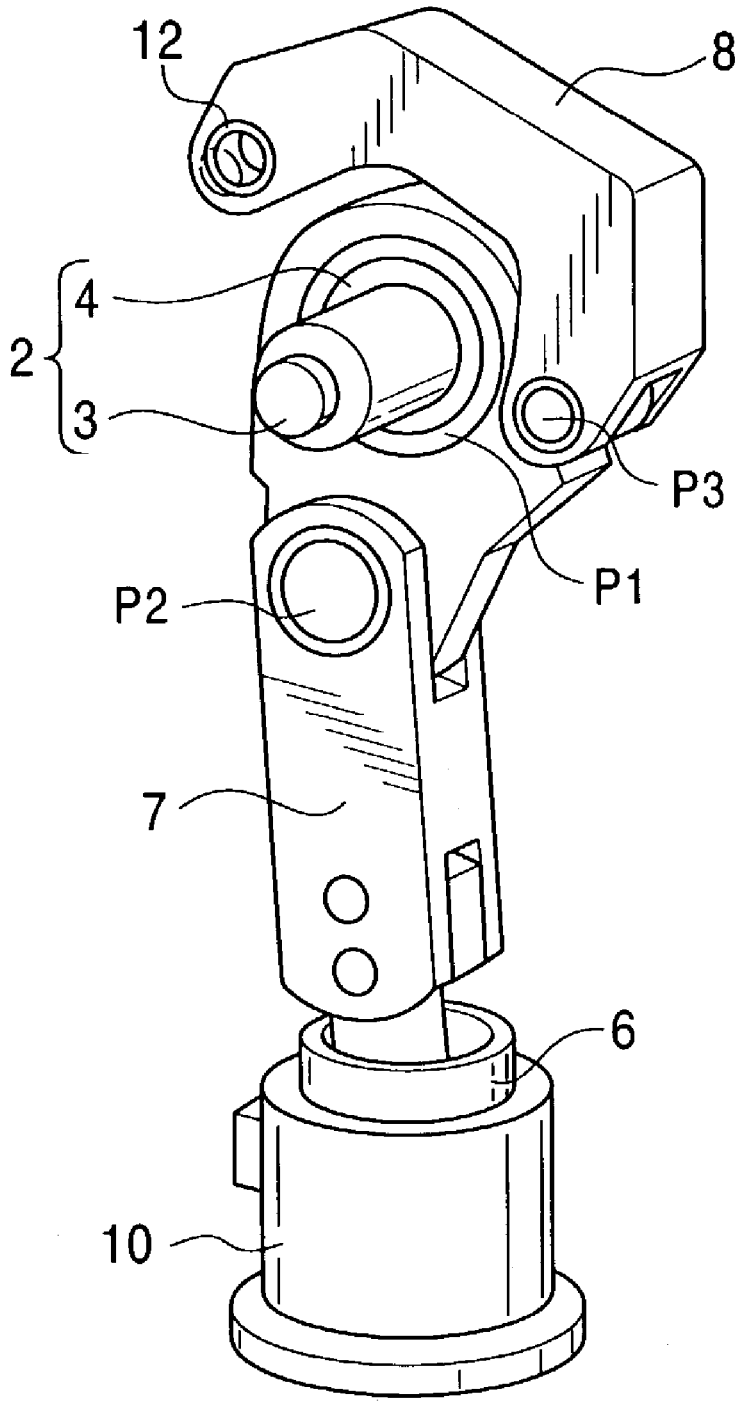
FIG. 6 is a partial perspective view of this link mechanism.

As shown in FIGS. 4 and 5, the crank shaft 3 is connected to an output shaft (not shown in the drawings) of the motor 13 via the drive transmitting system 14. The drive transmitting system 14 can control rotation of the motor 13 to transmit rotational driving effected by the motor 13 to the crank shaft 3 so that an elevating and lowering operations of the ram 6 can be controlled. Accordingly, the drive transmitting system 14 is means for transmitting the torque of the motor 13 without using any parts such as a flywheel which are intended to apply inertia. In this embodiment, the drive transmitting system 14 is composed of a speed reducer 15 and a coupling 16 that connects an output shaft of the speed reducer 15 to the crank shaft 3. The motor 13 is a servomotor. The speed reducer 15 and the motor 13 are, for example, integrated together to constitute a motor with a speed reducer.

Figure 2:
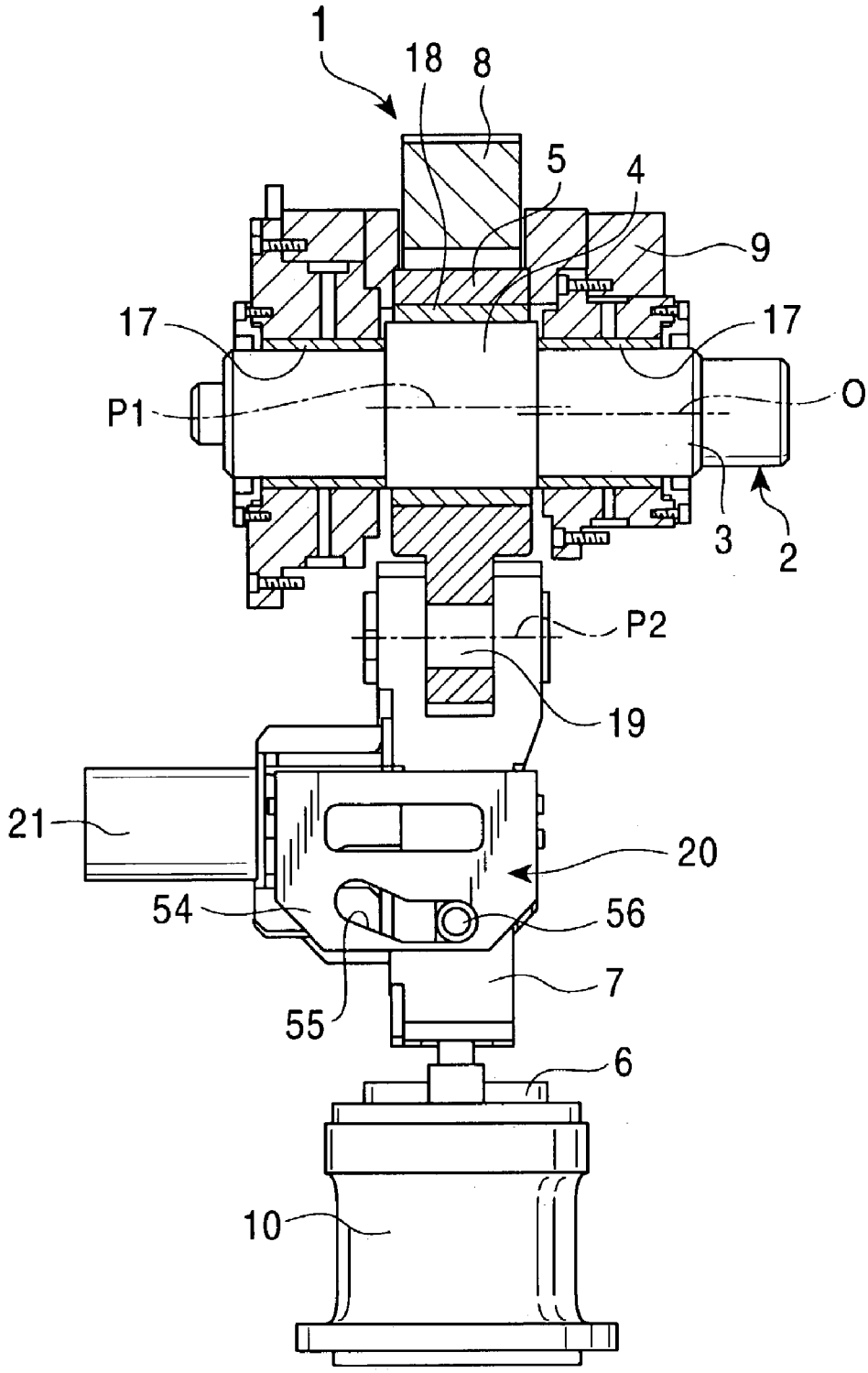
FIG. 2 is an exploded side view of this link mechanism.
Figure 3B:
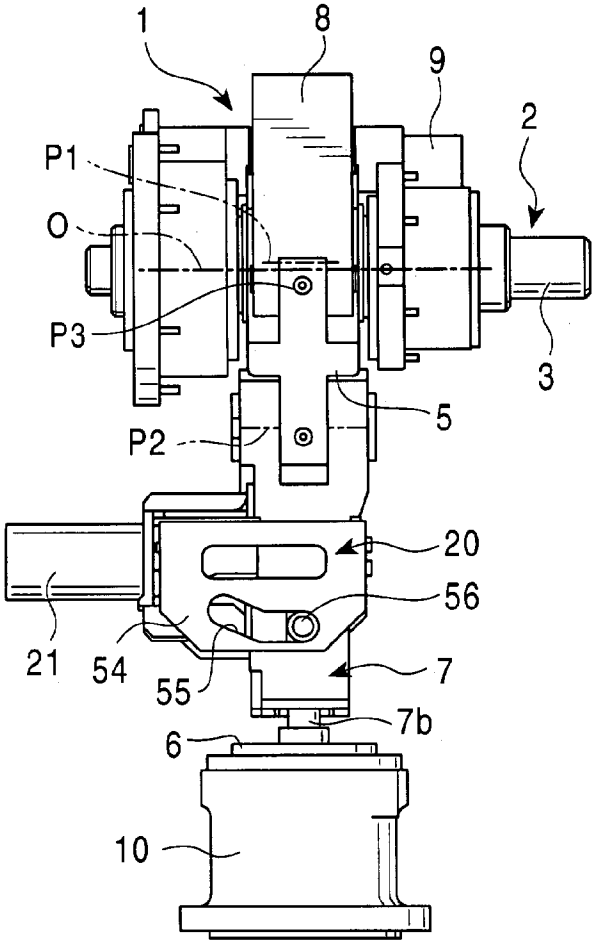
FIGS. 3A and 3B are a front view and a side view of this link mechanism, respectively.
Figure 3A:
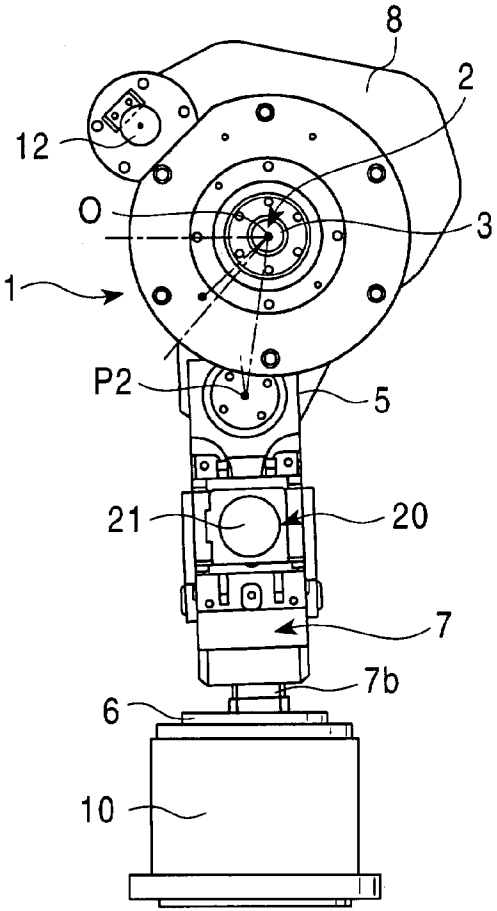

FIG. 2 is an exploded side view of the link mechanism 1. The crank shaft 3 extends from the opposite sides of the eccentric shaft portion 4 and is rotatably supported on the frame 9 via a bearing such as a journal bearing at the opposite sides. In the pivoting link 5, the inner diameter surface of a connecting hole constituting the first connecting portion P1 is fitted over the outer periphery of the eccentric shaft portion 4 via a liner 18. The second connecting portion P2 of the pivoting link 5 and the connecting rod 7 are connected together by a connecting pin 19.

The connecting rod 7 has a ram shift mechanism 20 at an intermediate position in its length direction to change its length between two levels to switch the lower end position of the ram 6 between an upper shift position and a lower shift position. The ram shift mechanism 20 has a shift driving source 21 composed of a cylinder device or the like and driven to switch the shift position. As described in detail later, the switching of the shift position is used to allow a punch tool to be replaced with a different one while keeping the top dead center of the punch tool lower than a standby punch tool on a turret, the top dead center being associated with driving with the ram 6. The top dead center of the punch tool is kept lower in order to improve the cycle time and allow the use of a crank member 2 with a small eccentricity to reduce the torque of the motor. Both link mechanism 1 and ram shift mechanism 20 serve to reduce the torque. The distance between the lower shift position and the bottom dead center, i.e. an elevating and lowering stroke of the punch tool and the ram 6, is about the triple of eccentricity of the eccentric shaft portion 4 of the crank member 2.

As shown in FIG. 5, the frame 9 is an independent link portion frame that supports the link mechanism 1. It is attached to the leading end of upper frame portion 22*a* of a main body frame 22. The link portion frame 9 is shaped like a box. The frame 9 supports the opposite ends of the crank shaft 3 using a support plate 9*b* provided on the inner surface of an attaching substrate 9*a* and an opposite 9*c* opposite to the support plate 9*b*. A motor supporting member 23 is provided on the frame 9. The motor 13 is installed on the motor supporting member 23. Accordingly, the motor 9 is removably assembled to the main body frame 22 together with the link portion frame 9 on which the link mechanism 1 is installed.

The main body frame 22 has a C-shaped side having an opening portion 24 into which a plate material workpiece or a tool support is advanced. The main body frame 22 has a pair of opposite side plates. FIG. 5 shows only one of the opposite side plates. In the upper frame portion 22*a*, the opposite side plates are joined together using an upper-frame bottom surface plate 25 and an intermediate reinforcing plate 26.

Figure 10:
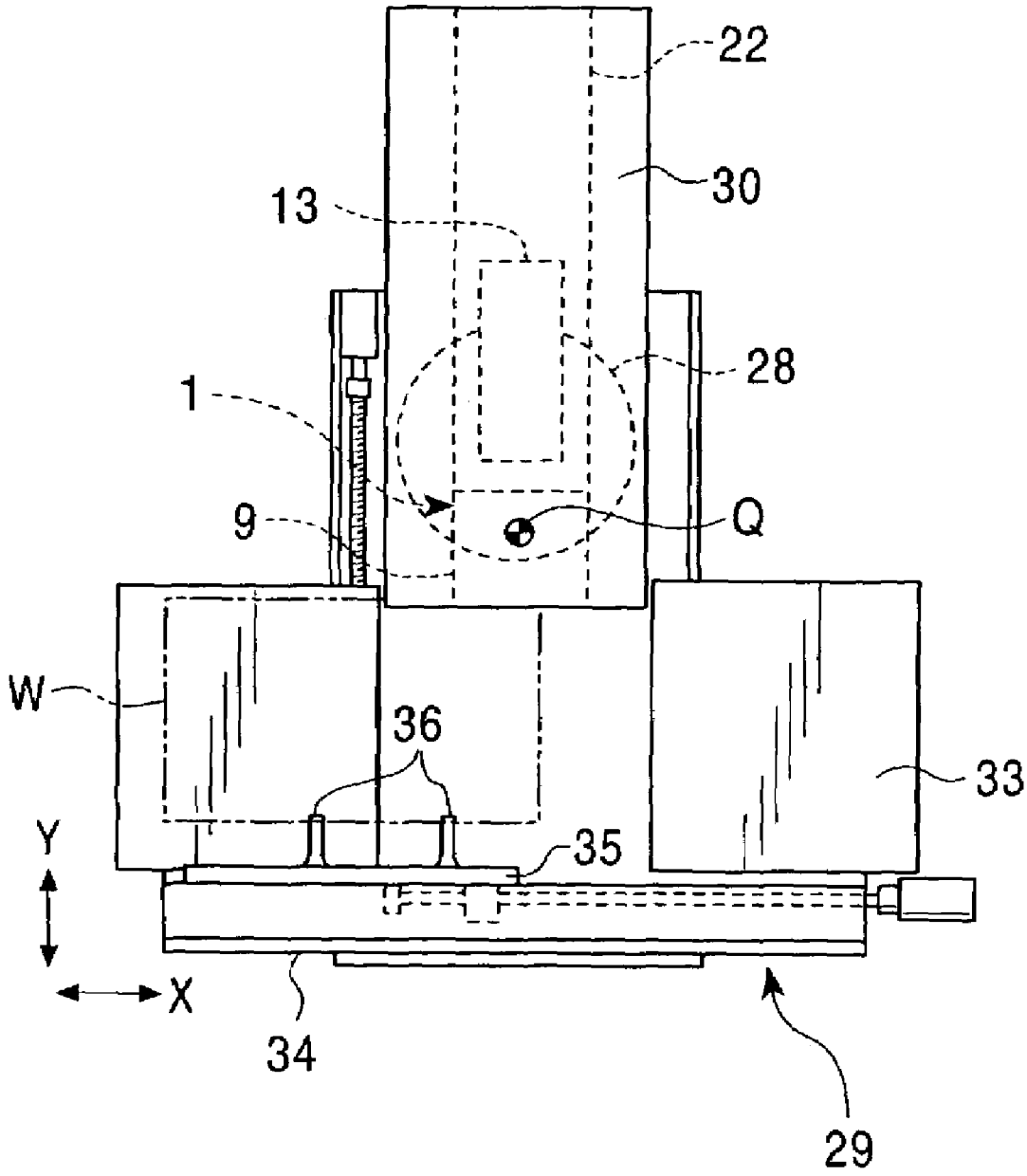
FIG. 10 is a plan view showing the whole motor driven link press of this embodiment.
Figure 11:
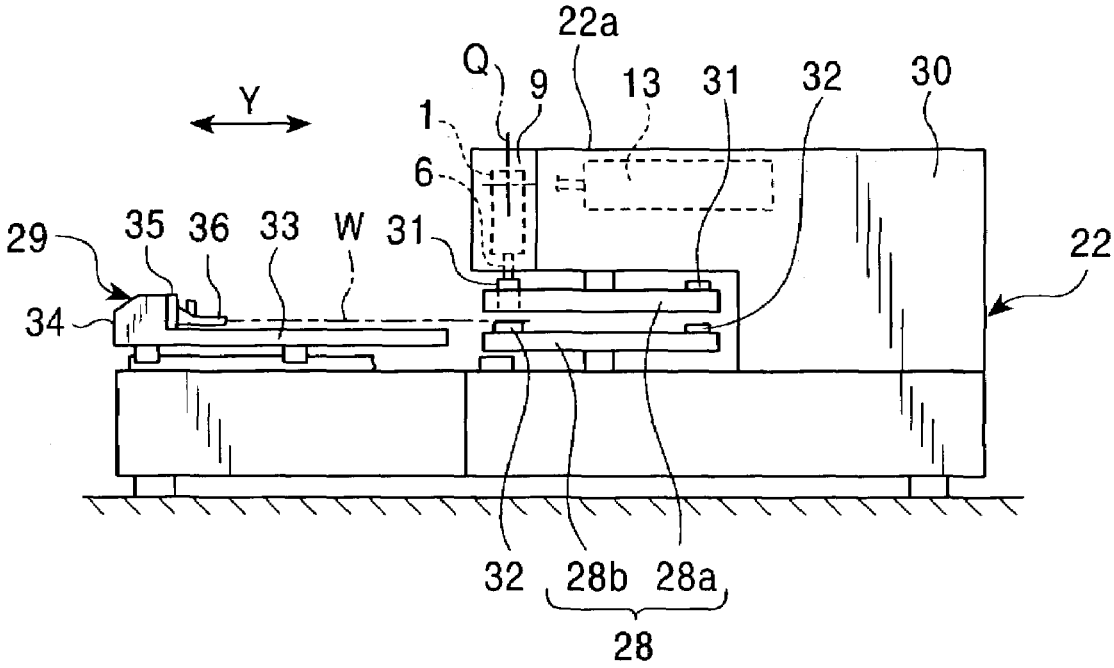
FIG. 11 is a side view showing the whole motor driven link press.

FIGS. 10 and 11 are a general plan view and side view showing an example in which the motor driven link press provided with the link mechanism 1 in FIG. 1 is applied to a punch press. The main body frame 22 is covered with a frame cover 30. In addition to the link mechanism 1, tool supporting means 28 and work feeding means 29 are installed in the main body frame 22. A plurality of punch tools 31 and die tools 32 are mounted on the tool supporting means 28 so that any one of the tools 31, 32 can be indexed to a position Q at which the ram 6 carries out press working (FIG. 11). The tool supporting means 28 is composed of an upper turret 28*a* and a lower turret 28*b* on which the punch tools 31 and the die tools 32, respectively, are mounted. The work feeding means 29 moves a plate material workpiece W on a table 33 in the directions of two orthogonal axes (X-axis and-Y axis) so that an arbitrary portion of the workpiece W is located at the press working position Q. The work feeding means 29 has a carriage 34 moving in a longitudinal direction (the direction of the Y axis) and a cross slide 35 mounted on the carriage 34 so as to move in a lateral direction (the direction of the X axis). A plurality of work holders 36 provided on the cross slide 35 grasp the plate material workpiece W. The plate material workpiece W is fed in the direction of the two axes by the longitudinal movement of the carriage 34 and the lateral movement of the cross slide 35.

Figure 8:
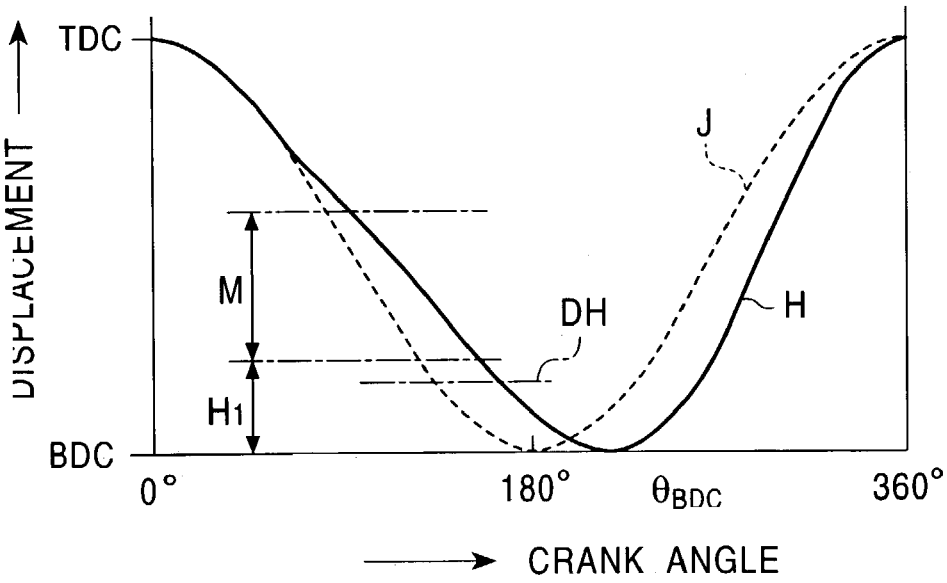
FIG. 8 is a graph showing the relationship between a crank angle and the displacement of a ram in this link mechanism.

The operation of the above configuration will be described. A description will be described later of the specific configuration and operation of the ram shift mechanism 20. The link mechanism 1 in FIG. 1 performs the operation described below as can be seen in the schematic diagram in FIG. 7. When the crank shaft 3 is driven and rotated by the motor, the center of eccentric shaft portion 4 of the crank member 2 draws a circumferential locus C1 around the axis of the crank shaft 3 as shown in FIG. 7. The pivoting link 5 is rotatably connected to the eccentric shaft portion 4 via the first connecting portion P1 and thus makes revolutionary motion along the circumferential locus C1. The pivoting link 5 is connected to the restraining link 8 via the third connecting portion P3 and thus has its operation regulated. Concurrently with the revolutionary motion, the pivoting link 5 makes rotational motion by pivoting back and forth around the first connecting point P1. The composite operation including this revolutionary motion and rotational motion causes the second connecting portion P2 to move along an oblique elliptical locus C2 as shown in this figure, the connecting portion P2 being provided in the pivoting link 5 to connect to the connecting rod 7. The ram 6 is supported so as to only elevate and lower freely and is connected to the second connecting portion P2 of the pivoting link 5 via the connecting rod 7. Accordingly, the ram 6 elevates and lowers when the second connecting portion P2 draws an elliptical locus. The speeds of elevating and lowering operations of the ram 6 are asymmetric as shown in FIG. 8 by a curve H indicating the relationship between crank angle and displacement during one period. Further, a crank angle θ BDC at which the ram 6 reaches a bottom dead center BDC is different from 180 degrees. A curve J, also shown in FIG. 8, indicates the vertical displacement of a ram in a general crank mechanism. It also indicates that the lowering and elevating speeds are symmetric.

The operation of the link mechanism 1 is affected by the following eight elements shown in FIG. 7: the crank length (eccentricity) r, the length w of the restraining link 8, the length L of the connecting rod 7, the opening angle α between the connecting portions P2, P3 of the pivoting link 5, the lengths a, b between the connecting portion P1 and both connecting portions P2, P3 of the pivoting link 5, and Ex on the coordinate X and Ey on the coordinate Y of the support point position of the restraining link 8. The center of the coordinates is the axis of the crank shaft 3.

To establish the link mechanism 1, a four-node rotation chain must be established in which the rotational center of the crank shaft 3, the connecting portion P1, the connecting portion P3, and the support shaft 12 of the restraining link 8 are established as the connecting points between the nodes. Further, when the shortest node is defined as the crank length r, the expressions shown below must be met.

When $A=\sqrt{(Ex^2+Ey^2)}$ $$r+a \leqq w+A$$

$$r+w \leqq a+A$$

$$r+A \leqq a+w$$

This is known as the Grashof formula. The displacement curve of the ram 8 can be freely designed by properly setting values for the above elements so as to meet these conditions.

Which of the lowering and elevating operations is faster is determined by the rotating direction of the motor and the combination of the above elements. Thus, when the motor is rotated in a fixed direction, the proper design of the elements enables an operation in which the lowering speed of the ram 6 is lower than its elevating speed when the motor 13 is rotated at a fixed speed. In this manner, a decrease in lowering speed enables working with a heavy press load and increases the elevating speed, even with the use of a relatively low output power. This improves a working cycle time.

Figure 9A:
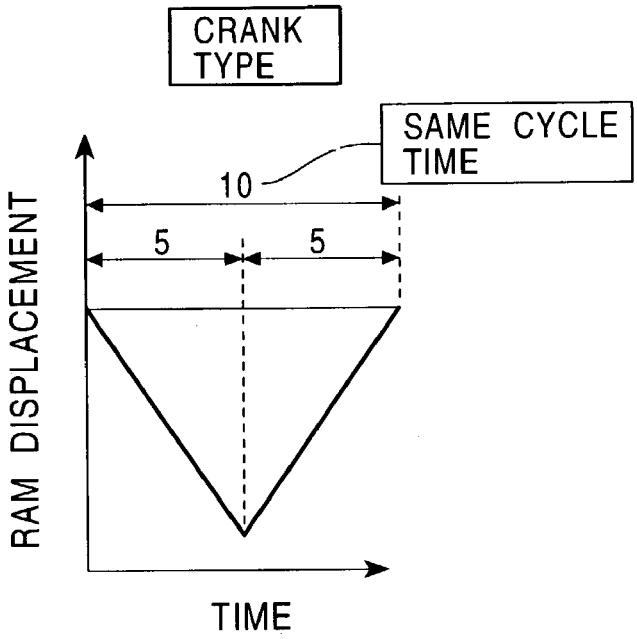
FIG. 9 is a graph showing a comparison of this link mechanism with a crank type press in terms of process of the ram displacement.
Figure 9B:
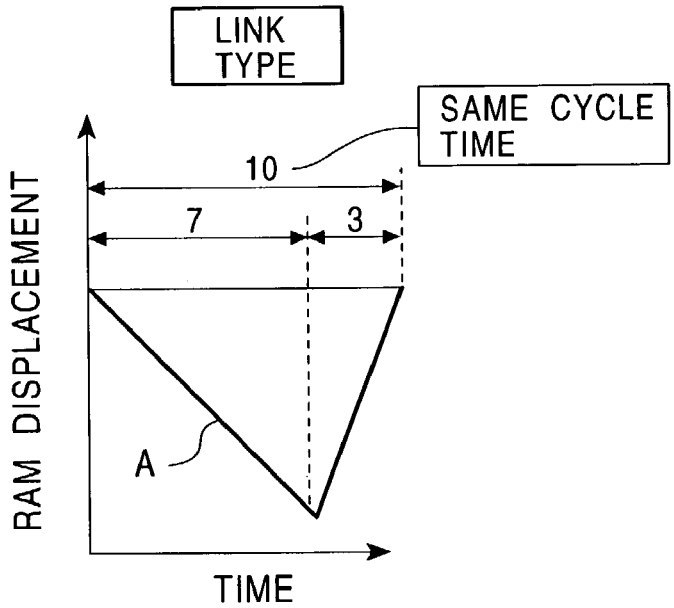

FIG. 9 shows a comparison of a crank type press with a link type press. If the cycle time is expressed as "10", both lowering and elevating times of the crank type are "5" as shown in FIG. 9A. However, the link type can be designed so that the lowering time is "7" and the elevating time is "3" as shown in FIG. 9B. If the link mechanism 1 is designed in this manner, then the ram speed during a lowering operation is lower than that accomplished with the crank type; the crank type press is five-sevenths of the link type press. The press load is correspondingly heavier than that can be accomplished with the crank type; the crank type press is seven-fifths of the link type press. Ibis amounts to a 40% improvement in press load. When the ram 7 elevates, work is not particularly carried out. Consequently, working is not affected by the weaker force.

Further, the above speed change is made with the motor speed fixed. Accordingly, the use of a speed reducer 15 (FIG. 4) with an appropriate reduction ratio enables the motor to operate at a motor rotation speed at which it provides the maximum output power according to its characteristics. This also allows the use of the motor 13 with low output power. Further, the motor 13 and the crank shaft 3 are connected together via the drive transmitting system 14 that does not include any inertia applying systems such as a flywheel. Therefore, control can be properly provided easily, e.g. the ram speed can be changed by controlling the rotation speed of the motor.

If the motor 13 is a servomotor, the motor speed can be freely changed. Accordingly, the speed of the ram 6 can also be changed during its elevating and lowering stroke. This enables working according to various requirements. That is, a speed curve based on operations of the link mechanism 1 composed of the crank member 2, pivoting link 5, restraining link 8 and the like is used as a basic speed curve observed if the motor 13 is rotated at a uniform speed, and the motor speed is varied. Then, for example, the speed at which the punch tool 31 contacts with the plate material workpiece W can be reduced to make operations more silent. Alternatively, the elevating speed can be further increased. Further, the ram 6 can be stopped at an arbitrary height.

If this motor driven link press is used to carry out press working, a punch section M used to punch the plate material workpiece W must be an intermediate section of lowering process of a ram elevating and lowering stroke. In the intermediate section used as the punching section M, a curve H for displacement with respect to the crank angle of the ram 6 is substantially linear. A lower limit position H1 of the punching section M is located slightly above a die height DH.

With the link-press, when the motor speed is fixed, the curve is gentle near the top dead center TDC, linear during the intermediate section, and gentle again near the bottom dead center BDC. The speed is lowest near the bottom dead center BDC so that the heaviest press load is obtained near the bottom dead center BDC. With a conventional link press for forming, a heavy press load near the bottom dead center BDC is used for forming. However, with punch working, a stroke must be provided below the bottom surface of the plate material workpiece W to ensure that punching scraps are dropped. In contrast, if the intermediate section of the stroke is the punching section M, a sufficient stroke can be provided below the bottom surface of the plate material workpiece W to ensure that punching scraps are dropped. Thus, an inherently light press load in the intermediate section can be compensated for by the link mechanism 1. In other words, the neighborhood of the bottom dead center BDC, in which a heavy press load is obtained, can thus not be used but the link mechanism 1 can be used more efficiently than the conventional crank mechanism with symmetrical operations. Press working requires not only a heavy press load but also an increased working speed. Further, for punch working, a higher punching speed improves working quality. Further, the use of the intermediate section as the punching section M efficiently provides the punching speed required to achieve the desired working quality. In this manner, if this embodiment is applied to a punch press, the operation of the link mechanism 1 can be effectively used in a manner different from the one in which the conventional link press for forming is used.

Figure 13:
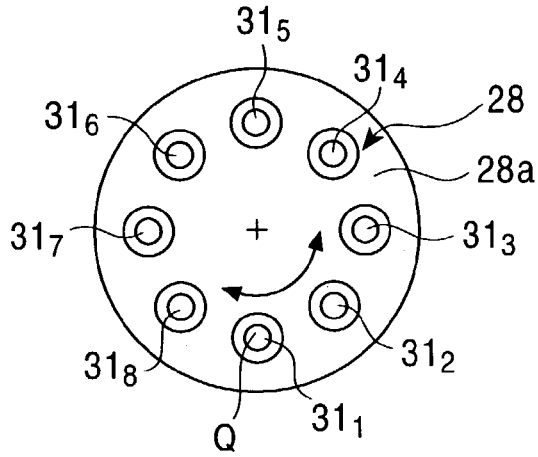
FIG. 13 is a plan view of a turret in this motor driven link press.

Now, with reference to FIGS. 13 and 14, a description will be given of the height relationship between each shift position of the ram shift mechanism 20 and the punch tools 31 on the tool supporting means 28. The punch tools 31 (311 to 318) supported at the respective positions on the upper turret 28*a* of the tool supporting means 28 are held at a given height except the punch tool 311 at a press working position Q. The punch tools are held at the given height by, for example, engaging necks of the punch tools 31 with respective position-fixing guide rings (not shown in the drawings) provided on the turret 28*a* along its circumferential direction or providing the turret 28*a* with supporting spring members (not shown in the drawings) for the respective punch tools 31. The guide rings are each shaped to have a lacking portion at the press working section Q. The height of each punch tool 31 supported on the turret 28*a* as described above corresponds to, for example, the position at which the bottom surface of the punch tool 31 is located substantially at the bottom surface of the turret 28*a*.

In this embodiment, the ram 6 is adapted to engage with the neck of the punch tool 31 carried to the press working position Q to forcibly pull this tool 31 up. The punch tools 31 at the other positions are supported by the guide rings. The neck is engaged with the ram 6 by fitting a T-shaped head of the punch tool 31 into a groove formed in the lower end of the ram 6 and having a T-shaped cross section and suspending the neck of the punch tool 31, corresponding to a constricted portion of the T-shaped head.

Figure 14A:
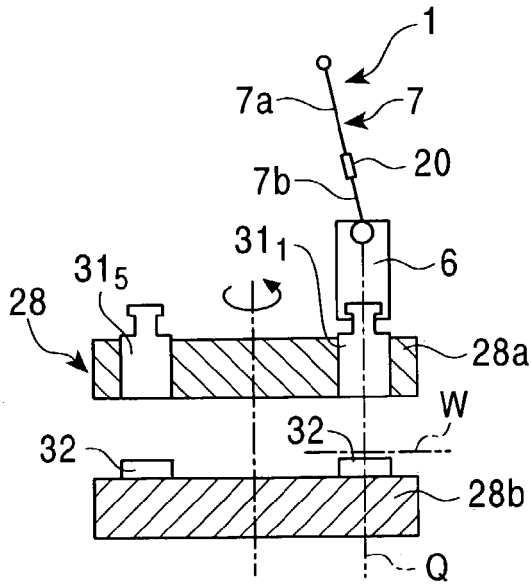
FIGS. 14A and 14B are exploded side views showing the positional relationship between the ram and the turret and a punch tool, at an upper shift position and a lower shift position of this motor driven link press, respectively.
Figure 14B:
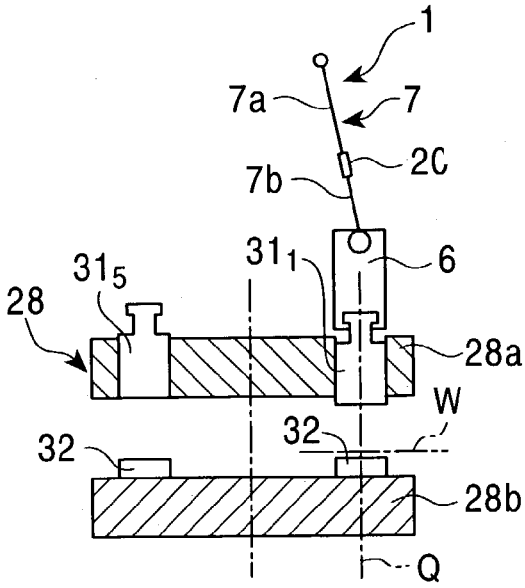

To use the ram 6 to drive elevating or lowering of the punch tool 31 at the press working position Q, the punch tool 31 at the top dead center position of elevating and lowering stroke of the ram 6 is positioned below the other punch tools 31 on the turret 28*a* as shown in FIG. 14B. If the top dead center position of the punch tool 31 at the press working position Q is thus lowered and the height of the ram 6 remains unchanged, when the turret 28*a* is rotated, the other punch tools 31 may interfere with the side of the ram 6 to hinder the tool from being changed for the ram 6. This is because the lower end of the ram 6 extends below the upper end of each of the other punch tools 31 on the turret 28*a*.

Thus, the ram shift mechanism 20 is used to switch the lower end position of the ram 6 between the upper shift position and the lower shift position. In this case, after the ram 6 has been set at the top dead center position using the link mechanism 1 and at the upper shift portion using the ram shift mechanism 20, the punch tool 31 supported by the ram 6 is placed at the same height as the other punch tools 31 on the turret 28*a* as shown in FIG. 14A. Then, the tool can be smoothly changed for the ram 6 simply by rotating the turret 28*a*.

Punch working is carried out by using the ram shift mechanism 20 to set the ram 6 at the lower shift position as described above. This enables the top dead center of elevating and lowering stroke of the punch tool 31 to be lowered to minimize the distance between the punch tool 31 and the surface of the plate material workpiece W. This allows the ram stroke to be designed to be shorter.

It is thus possible to reduce the time elapsed after the punch tool 31 has left the top dead center and before it comes into contact with the surface of the plate material workpiece W or the time required for the punch tool 31 to elevate and retreat. Therefore, the cycle time for working can be improved. While the top dead center of the punch tool 31 is lowered to improve the cycle time, the tool can be easily changed for the ram 6.

Figure 12A:
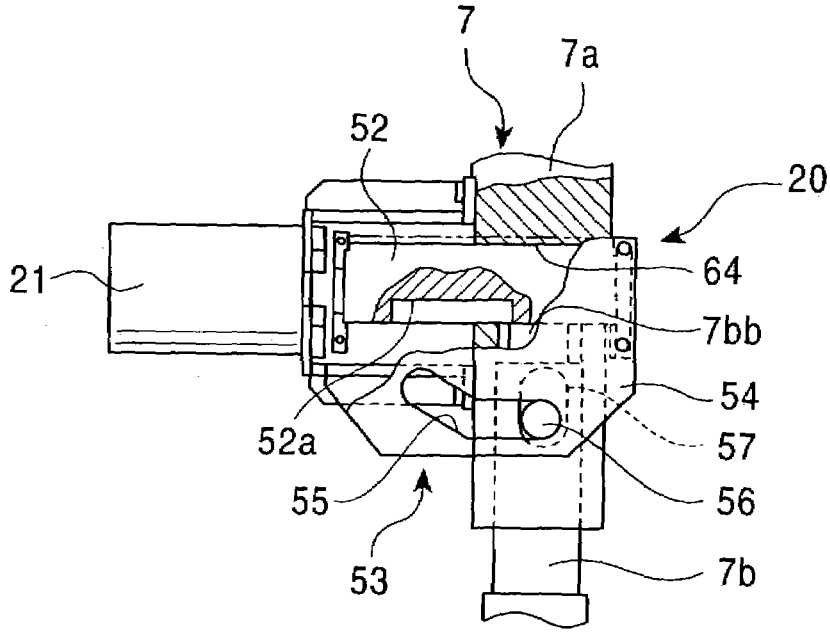
FIG. 12 is an exploded side view showing a lower shift condition and a lower shift position of a ram shift mechanism in this motor driven link press.

The ram shift mechanism 20 will be described in detail with reference to FIGS. 1 and 12. In the ram shift mechanism 20, the connecting rod 7 is divided into an upper rod 7*a* and a lower rod 7*b* that are coupled together so as to expand and contract freely. A slider 52 (FIG. 12) is releasably interposed between the ends of the upper and lower rods 7*a*, 7*b*. A releasing position of the slider 52 determines the thickness of that portion of the slider 52 which is present between the upper and lower rods 7*a*, 7*b*. Further, the ram shift mechanism 20 is provided with an interlocking mechanism 53. The interlocking mechanism 53 operates mechanically in union with the insertion or removal of the slider 52 to elevate or lower the lower rod 7*b* so as to allow the upper and lower rods 7*a*, 7*b* to contact with each other via the slider 52 without any gaps even when the slider 52 is inserted or removed.

In the divided portion of the connecting rod 7, the upper part of the lower rod 7*b* is removably coupled to the lower part of the upper rod 7*a*. Specifically, the bottom of the upper rod 7*a* is formed to be hollow so that the upper part of the lower rod 7*b* is fitted into this hollow hole so as to be slidable in a longitudinal direction of the rod 7.

The interlocking mechanism 53 is a cam mechanism composed of guide plates 54 each having a guide slot 55 and active rods 56 that engage slidably with the respective guide slots 55 in the guide plate 54. The two guide plates 54 are provided on the respective sides of the slider 52 and fixed to the slider 52 at their front and rear ends. The guide plate 54 has the guide hole 55 formed in its portion protruding below the slider 52. The pair of active rods 56 is provided at the upper end of the lower rod 7*a* so as to protrude in a direction orthogonal to the longitudinal direction of the rod 7*a*. The active rods 56 engage with the respective guide slots 55, located on the corresponding sides of guide plate 54. A slot 57 out of which the active rods 56 of the lower rod 7*b* are protruded is formed in the lower part of the upper rod 7*a*, which is formed into a hollow shaft, along its longitudinal direction.

Figure 12B:
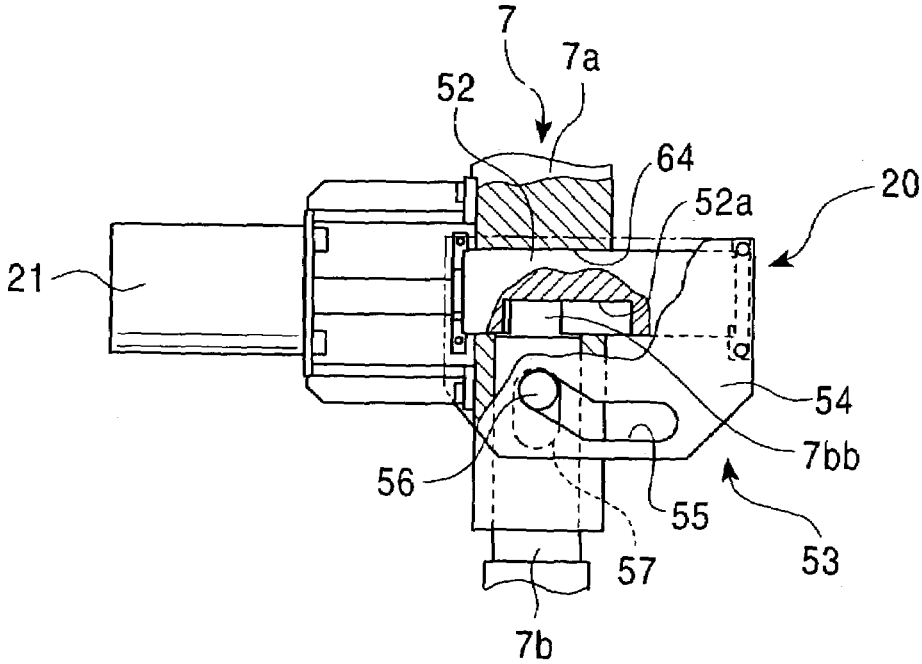

The guide slots 55 in the respective guide plates 54 are shaped so that their front half extends in a substantially horizontal direction, while their rear half is inclined upward. When the guide plates 54 are advanced together with the slider 52 as shown in FIG. 12B, the lower rod 47*b* is lifted while being guided by the guide slots 55. This reduces the external length of the connecting rod 7.

The slider 52 is releasably inserted into a horizontal hole 64 formed in the upper rod 7*a*, and is advanced and retreated by a shift driving source 21 attached to the upper rod 7*a* and composed of an air cylinder or the like. Specifically, the horizontal hole 64 is formed along the upper bottom surface of hollow shaft portion of the upper rod 47*a*. Further, a fitting concave 52*a* into which an upper end 7*bb* of the lower rod 7*b* is fitted is formed in the bottom surface of the slider 52, which is opposite the upper end 7*bb* of the lower rod 7*b*. The upper end 7*bb* of the lower rod 7*b* can be fitted into the fitting concave 52*a* after the slider 52 has moved to a predetermined releasing position with respect to the upper rod 7*a*. Since the fitting concave 52*a* is formed, the thickness of the slider 52 varies depending on its releasing position. That is, a portion of the slider 52 in which the fitting concave 52*a* is formed is thinner. On the other hand, a portion of the slider 52 in which the fitting concave 52*a* is not formed is thicker. The upper end 7*bb* of the lower rod 7*b* is formed as a boss protruding from the upper end surface of the lower rod 7*b*.

The ram shift mechanism 20 is set at the lower shift position in order to carry out press working. In FIG. 1, ram axis control means 61 for controlling the motor 13 used to drive the crank shaft 3 permits the motor 13 to drive the crank shaft 3 after the ram shift mechanism 20 has set the ram 6 at the lower shift position. The ram shift mechanism 20 has shift position detecting means 62 for detecting the lower shift position. The shift position detecting means 62 may be provided in the shift driving source 21. The ram axis control means 61 controls the motor 13 according ram driving commands provided by a working program (not shown in the drawings) or the like. The ram axis control means 61 is provided, for example, as a part of a numerical control device (not shown in the drawings) that controls the entire motor driven link press.

Operations of the ram shift mechanism 20 will be described. To set the ram 6 at the upper shift position, the external length of the connecting rod 7 is reduced as described below. That is, the shift driving source 21 effects driving such that the slider 52 advances from the regular position shown in FIG. 12A to a predetermined position as shown in FIG. 12B. Thus, the fitting concave 52*a* in the slider 52 reaches a position at which it extends through the interior of the upper rod 7*a*. Further, the active rods 56 of the lower rod 47*b* are guided through the guide slots 55 in the guide plates 54, which advance integrally with the slider 52. The lower rod 7*b* advances into the fitting concave 52*a* in the slider 52 so that its upper end 7*bb* comes into contact with the upper bottom surface of the fitting concave 52*a*. The external length of the sliding rod 7 is thus reduced. When the shift driving source 21 effects such driving as returns the slider 52 to the position in FIG. 12A, the connecting rod 7 returns to its original length.

The ram shift mechanism 29 configured as described above thus expands and contracts the connecting rod 7. Consequently, compared to vertical shifting of the entire link mechanism 1 including the crank shaft 3 and the links 5, 8, it is unnecessary to have a large-scale mechanism or use a large-sized driving source for shifting. Further, the ram shift mechanism 20 has only to have a simple configuration. Furthermore, the connecting rod 7 is expanded and contracted by the operation of the interlocking mechanism 53, composed of the guide slots 55 and active rods 56, as the slider 42 is advanced and retreated. Consequently, no separate driving sources for expansion and contraction need be provided, thus further simplifying the configuration. This reduces costs. Further, the connecting rod 7 can be expanded or contracted before the slider 52 is completely moved. This reduces the operation time required for expansion and contraction.

If an attempt is made to use the motor 13 to drive the ram 6 with the ram shift mechanism 20 placed at the upper shift position, then the function of the ram axis control means 61 hinders the driving to prevent errors.

In the above described embodiment, the ram shift mechanism 20 expands and contracts the connecting rod 7. However, the ram shift mechanism 20 has only to be able to switch the lower end position of the ram 6 between the upper shift position and the lower shift position. For example, the ram shift mechanism 20 may shift the entire link mechanism 1 in a vertical direction.

Further, in the above descried embodiment, a servomotor is used as the motor 13. The servomotor need not necessarily be used. Furthermore, in the above description, the embodiment is applied to a punch press. However, the motor driven link press of the present invention is applicable not only to punch working but also to various other types of press working such as forming and bending.

Another embodiment will be described below with reference to the drawings.

Figure 15:
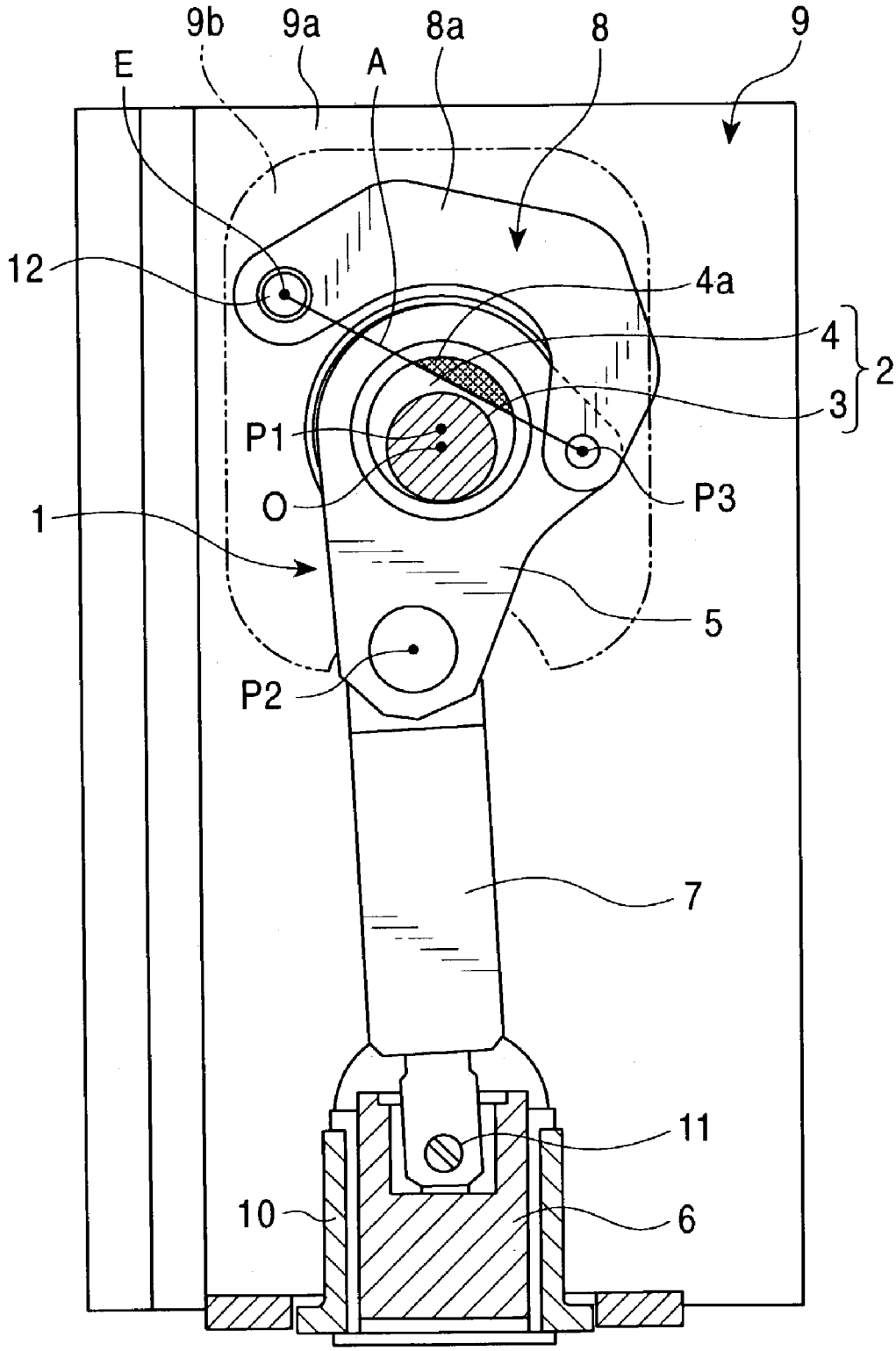
FIG. 15 is an exploded front view of a link mechanism in a link press according to another embodiment of the present invention.
Figure 16:
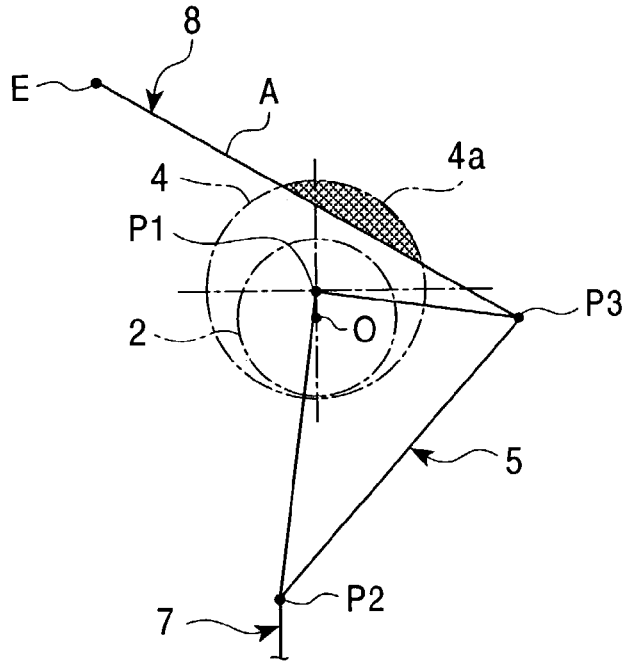
FIG. 16 is a schematic view showing the positional relationship among connecting portions in a predetermined operating condition of this link mechanism.

As shown in FIGS. 15 and 16, a pivoting center E of the restraining link 8, i.e. the axis of its support point shaft 12, and its third connecting portion P3 are arranged at the respective sides of the crank shaft 3. Further, the restraining link 8 is arranged so that when the eccentric shaft portion 4 of the crank member 2 is at the top dead center, a part 4*a* (shaded part) of the eccentric shaft portion 4 is located above a straight line A joining the pivoting center E of the pivoting link 8 with the connecting portion P3. In other words, the restraining link 8 is arranged so that when the eccentric shaft portion 4 is at the top dead center, the straight line A passes through the cross section of the eccentric shaft portion 4. FIG. 16 is a schematic view indicative of position of each portion when the eccentric shaft portion 4 is at the top dead center.

The restraining link 8 is shaped to have a bent portion 8*a* bent upward as shown in FIG. 15 to avoid interference with the pivoting link 5. In this embodiment, the bent portion 8*a* covers substantially the total length of the restraining link 8, so that the restraining link 8 is substantially entirely bent like an arc of a general semicircle. The bent portion 8*a* may be formed only in part of the restraining link 8 in its length direction.

In this link press, the pivoting center E and third connecting point P3 of the restraining link 8 are arranged at the respective sides of the crank shaft 3. Further, the restraining link 8 is arranged so that when the eccentric shaft portion 4 of the crank member 2 is at the top dead center, the part 4*a* of the eccentric shaft portion 4 is located above the virtual straight line A (FIG. 16) joining the pivoting center E of the pivoting link 8 with the connecting portion P3.

Figure 17:
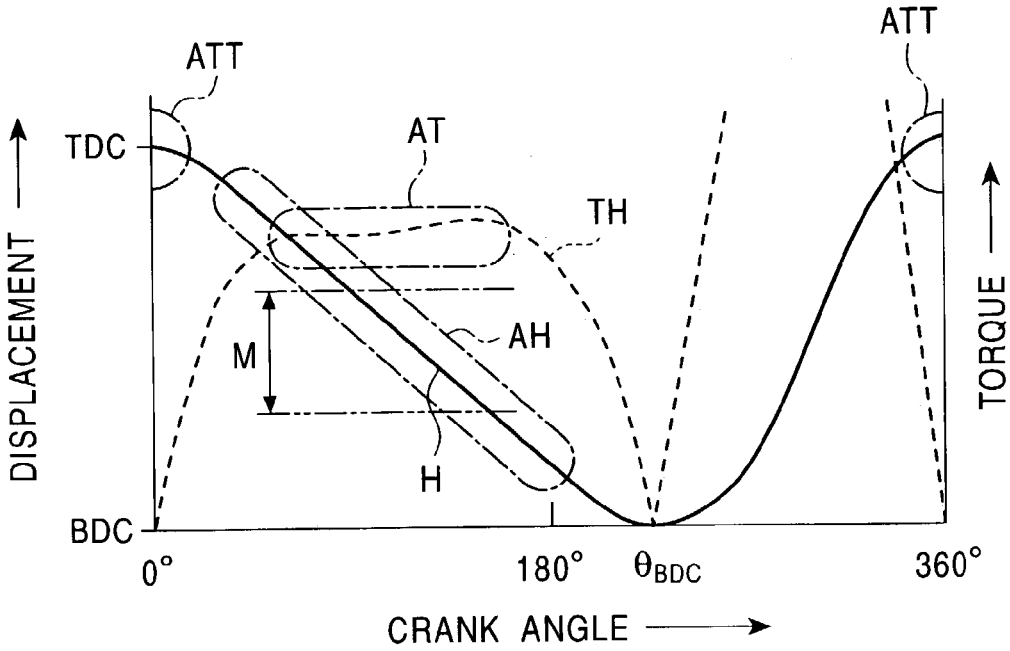
FIG. 17 is a graph showing the relationship between the crank angle and the ram displacement and the torque exerted on a crank shaft in the case in which the above positional relationship is established.
Figure 18:
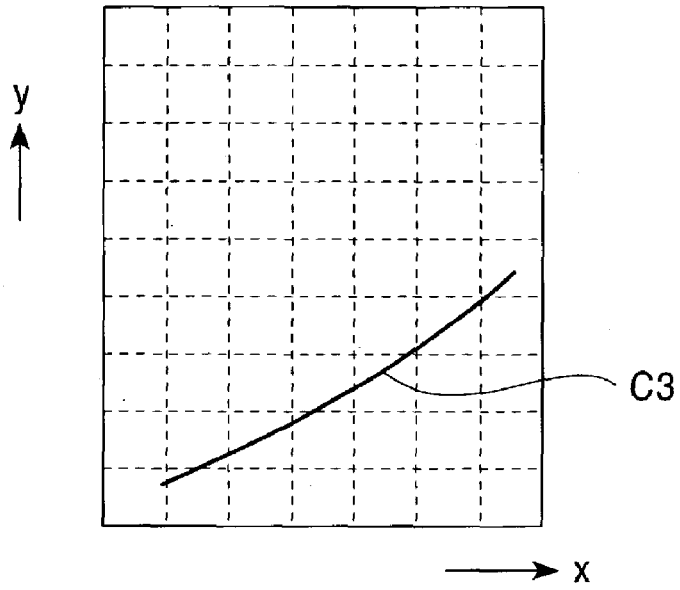
FIG. 18 is a graph showing a locus of a third connecting portion in the case in which the above positional relationship is established.
Figure 19:
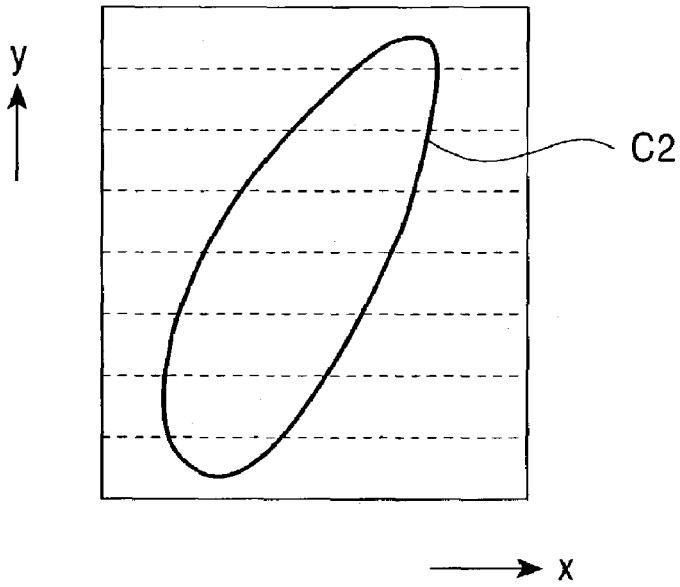
FIG. 19 is a graph showing a locus of a second connecting portion in the case in which the above positional relationship is established.

It has been confirmed that this arrangement relationship results in the operational characteristics indicated in FIG. 17. In this figure, the axis of abscissa indicates the crank angle during one period, whereas the axis of ordinate indicates the displacement of the ram and the torque exerted on the crank shaft when a predetermined load is applied to the ram. The crank shaft torque is proportional to the motor torque if the drive transmitting system 14 does not include any elements such as flywheel which are intended to apply inertia as in the case with this embodiment. A curve H indicates the ram displacement, and a curve TH indicates a variation in torque. In this case, it has been confirmed that the third connecting point P, constituting the leading end of the restraining link 8, reciprocates on a locus C3 of an arc curve as shown in FIG. 18 and that the second connecting point P2 draws a locus C2 of an elliptic curve as shown in FIG. 19.

As can be seen in FIG. 17, the parts of the ram displacement curve H corresponding to elevation and lowering, respectively, are asymmetric, and the crank angle θ BDC set when the ram 6 reaches the bottom dead center BDC is not 180 degrees as shown in FIG. 8 and described previously.

For a lowering operation, the ram displacement curve H exhibits linearity in a long section AH extending from the neighborhood of the top dead center TDC to the neighborhood of the bottom dead center BDC. The lowering speed of the ram 6 remains substantially fixed within the section All. Further, the torque remains almost fixed in a long section AT of the section AH which is longer than half of the section AH. The section AT with the substantially fixed torque can be effectively used for punch working as described later. Further, the ram displacement curve H is not angular but relatively gentle on sections ATT located near the top dead center TDC, specifically at the respective sides of the top dead center TDC. This indicates that the ram 6 is not significantly accelerated, i.e. the ram 6 does not markedly change its speed, when turning around at the top dead center TDC. Therefore, when the ram 6 changes its operating direction at the top dead center TDC, only a small impact is applied to the machine. This is advantageous in the design of strength of the machine and its durability.

In this manner, if this embodiment is applied to a punch press, the operation of the link mechanism 1 can be effectively used in a manner different from the one in which the conventional link press for forming is used. In particular, the operational characteristics shown in FIG. 17 are effective on punch working, the operational characteristics resulting from the restraining link 8 arranged so that the part 4*a* of the eccentric shaft portion 4 is located above the straight line A joining the pivoting center E of the pivoting link 8 with the connecting portion P3 as described above. As shown in this figure, in the intermediate section used as the range in which the ram 6 carries out working, the lowering speed of the ram 6 remains fixed. Further, the corresponding crank shaft torque remains constant. This serves to enable stable punch working.

Moreover, in the link mechanism 1, the pivoting center E and third connecting point P3 of the restraining link 8 are arranged at the respective sides of the crank shaft 3 as shown in FIG. 15. Consequently, this configuration is compact in the vertical and lateral directions. The restraining link 8 is shaped to have the bent portion 8*a* bent upward to avoid interference with the pivoting link 5. As a result, the compact link mechanism 1 with the above arrangement can be implemented without any interference with the pivoting link 5.

Figure 20:
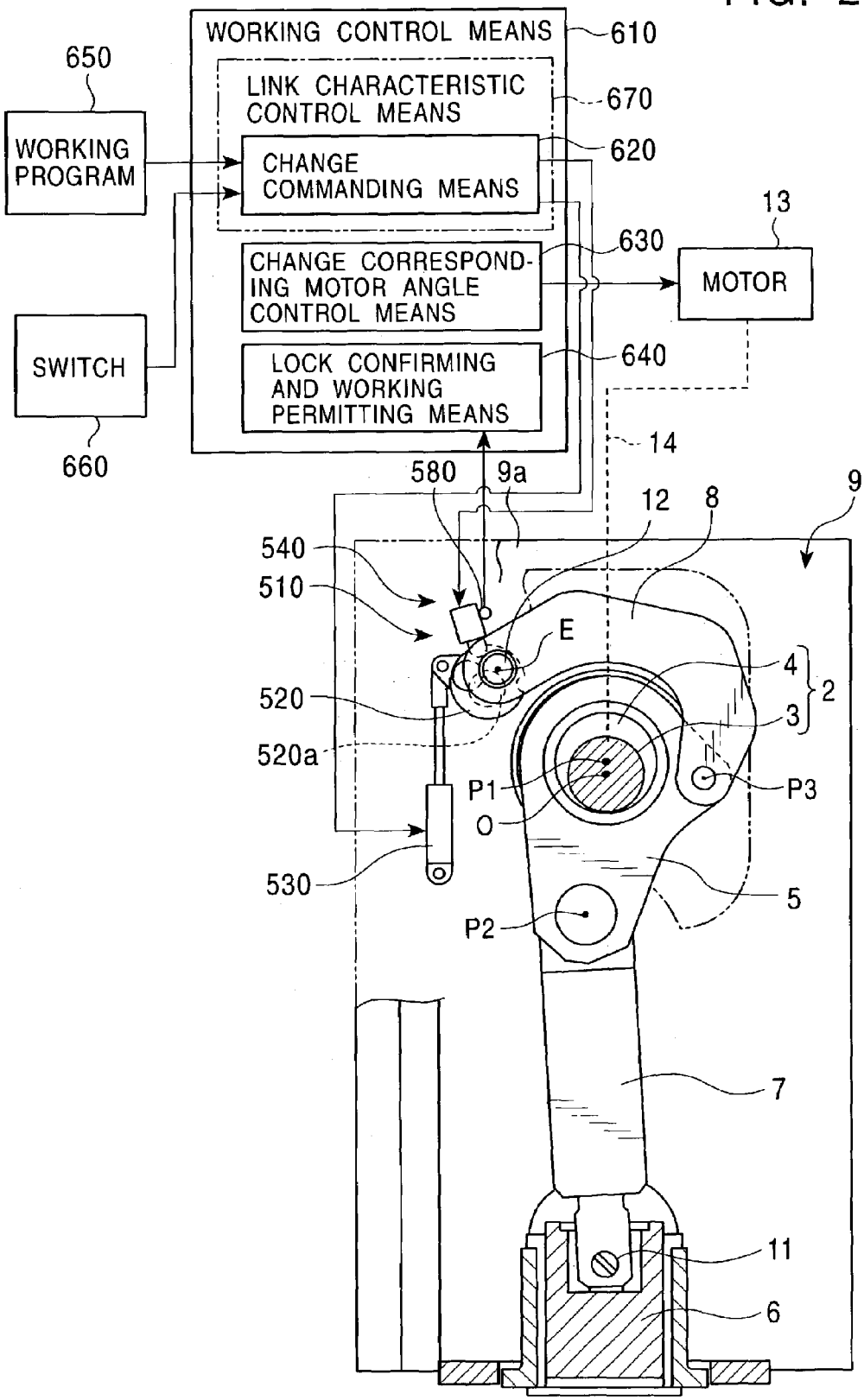
FIG. 20 is a combination of an exploded front view of a link mechanism in a motor driven link press according to yet another embodiment of the present invention and a block diagram showing a conceptual configuration of a control system.

Yet another embodiment of the present invention will be described below with reference to the drawings. FIG. 20 is a combination of a view of a link mechanism in this motor driven link press and a block diagram showing a conceptual configuration of a control system.

As shown in FIG. 20, the frame 9 is provided with a link rotational-movement center changing means 510 for changing the position of the rotational-movement center E at the proximal end of the restraining link 8. As shown in FIGS. 20 and 21, the link rotational-movement center changing means 510 is composed of rotational moving members 520 on which the support point shaft 12 is provided as an eccentric portion and an actuator 530 that rotationally moves the rotational moving members 520. Each of the rotational moving members 520 has a shaft portion 520*a* (FIG. 21) which coincides with its central portion. Using the shaft portion 520*a*, the rotational moving member 520 is rotatably supported on the frame 9 via a bearing (not shown in the drawings). The restraining link 8 has its proximal end rotationally movably supported on the support point shaft 12. The rotational moving members 520 are rotationally moved to change the position of the support point shaft 12 and thus the rotational-movement center E of the restraining link 8. The pair of rotational moving members 520 are coaxially provided, with the support point shaft 12 extending across both rotational moving member 520. The actuator 530 is a fluid pressure cylinder such as an air cylinder, or a motor, or an electromagnetic solenoid.

Lock means 540 is provided to fix the rotational-movement center E of the restraining link 8 at each position set by the link rotational-movement center changing means 510. The lock means 540 is composed of engaged portions 550 formed in the rotational moving member 520, a lock member 560 that engages with the engaged portion 550, and a disengagement driving source 570 that engages and disengages the lock means 560. The engaged portions 550 are each composed of a concave formed in the outer peripheral surface of the rotational moving member 520. The lock member 560 is composed of a pin-like member that can be freely advanced and retreated. The disengagement driving source 570 is composed of a fluid pressure cylinder or an electromagnetic solenoid and is installed on the frame 9. The two engaged portions 550 of the rotational moving member 520 are formed at the respective circumferentially separate positions. The lock member 560 can be engaged with the opposite engaged portion 550 by rotationally moving the rotational moving member 520. Accordingly, the rotational-movement center E of the restraining link 8 can be fixed at the two positions. Three or more engaged portions 550 may be formed so that the rotational-movement center E can be fixed at three or more positions.

This embodiment is characterized in that the link rotational-movement center changing means 51 in FIG. 20 changes the position of the rotational-movement center E to change the displacement curve for the ram 6 as described below.

Figure 21A:
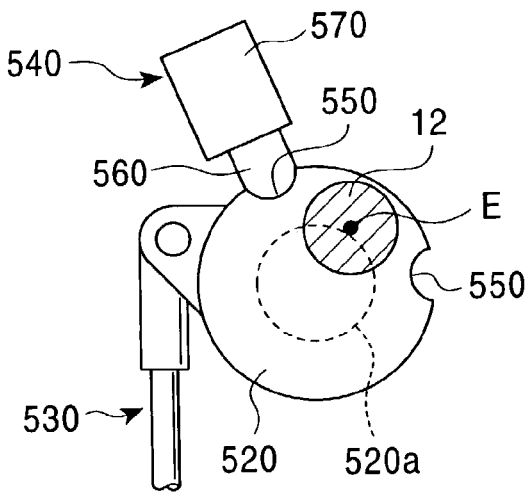
FIGS. 21A and 21B are exploded front views each showing an operating condition of a link rotational-movement center changing means, respectively.
Figure 22:
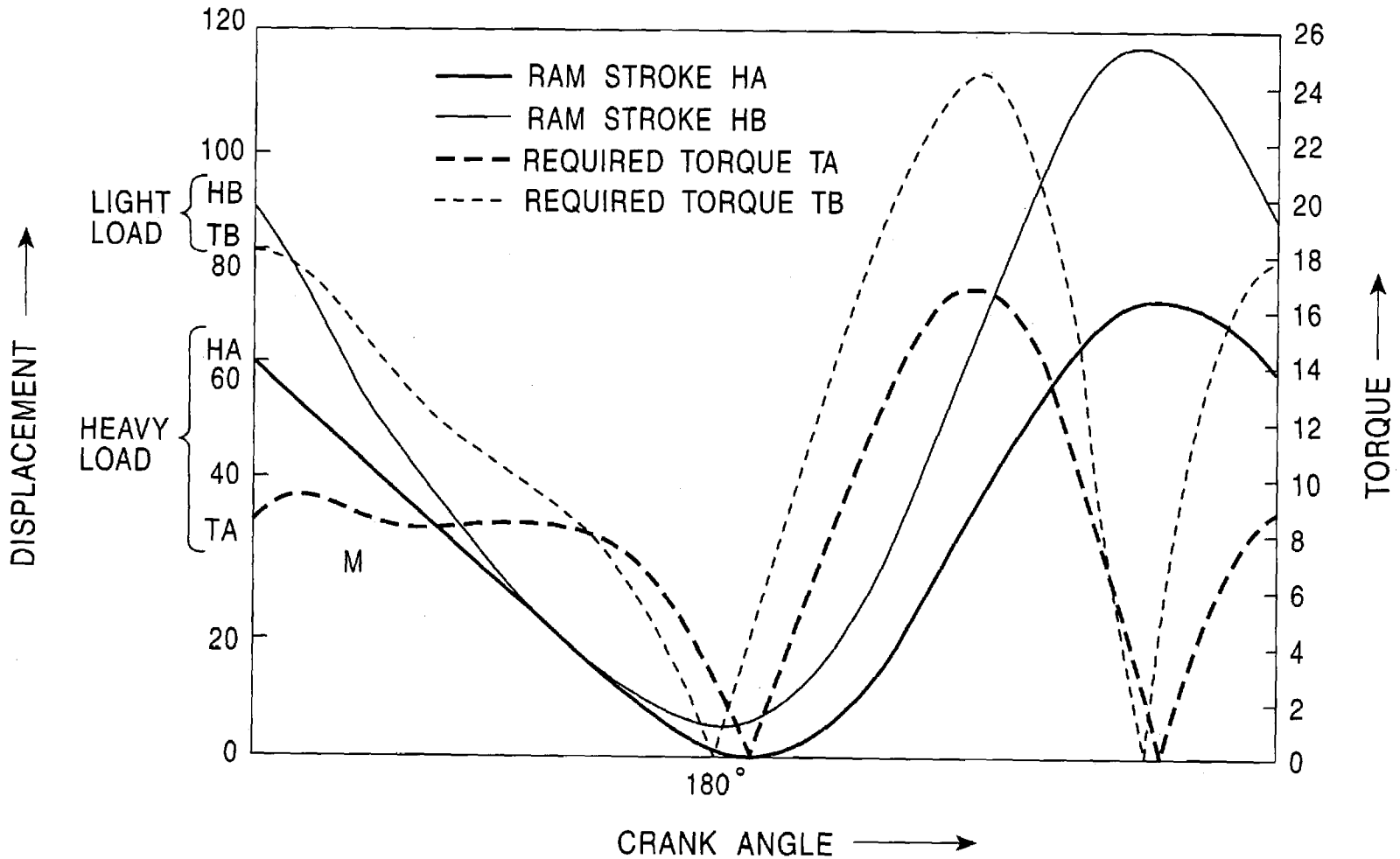
FIG. 22 is a graph showing the relationship between the crank angle and the ram displacement and the torque in this link mechanism, at each rotational-movement center position of a restraining link.

Description will be given of changes in link characteristics observed when the rotational-movement center E of the restraining link 8 is changed. With the positional and dimensional relationships established among the components of the link mechanism 1 shown in FIG. 20, the results of analysis indicate a ram displacement curve HA, shown in FIG. 22, is obtained if the rotational-movement center E is positioned in the upper part of the rotational moving member 520 as shown in FIG. 21A. This is the same as the ram displacement curve H shown in FIG. 8. For the convenience of comparison, FIG. 22 shows that, in the ram displacement curve HA, the crank angle corresponding to the bottom dead center is 180 degrees. The torque associated with the ram displacement curve HA results in a long lowering section in which the torque remains unchanged, as shown by a curve TA in FIG. 22.

Figure 21B:
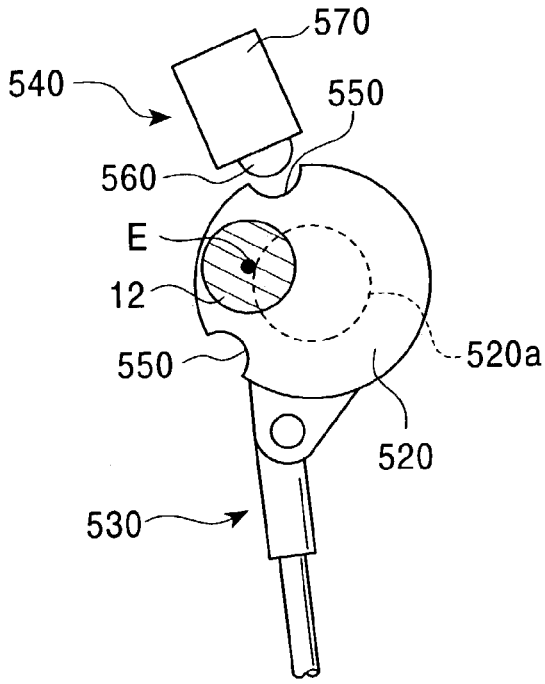

In contrast, when the rotational-movement center E is moved downward and leftward relative to its original position as shown in FIG. 21B, a ram displacement curve HB, shown in FIG. 22, is obtained. This curve indicates that the lowering speed of the ram is higher than that indicated by the curve HA obtained before the change. The torque associated with the ram displacement curve HB varies markedly as the ram lowers as shown by a curve TB in FIG. 22.

The link rotational-movement changing means 510 changes the rotational-movement center E to enable the free selection of one of the two ram displacement curves HA, HB.

The ram displacement curve HA, corresponding to a lower lowering speed, advantageously allows working to be accomplished using a motor 13 with low output power if working with a heavy load is carried out, e.g. if the plate material workpiece W has a large board thickness, if it is composed of a hard material, or if a punch tool with a large outer diameter is used for working.

The ram displacement curve HB, corresponding to a higher lowering speed, advantageously enables high-speed punching and thus high-quality working with few burrs if working is possible with a light load, e.g. if the plate material workpiece W has a small board thickness.

In this manner, the link rotational-movement center changing means 510 can be used to change the characteristics of the link mechanism 1 in order to select the optimum characteristics according to the type of working.

Link characteristic control means 670 (FIG. 20) is preferably provided depending on the type of working, to control the link rotational-movement center changing means 510. Link characteristic control means 670 is provided, for example, in working control means 610. The link characteristic control means 670 determines the type of working on the basis of predetermined working type identification information. The working type identification information may be, for example, predetermined commands or information in a working program 650, predetermined commands or information provided by higher control means (not shown in the drawings) for the working control means 610, or predetermined commands or information inputted from an operation panel (not shown in the drawings) by an operator. The link characteristic control means 670 has, for example, a correspondence table (not shown in the drawings) that shows the correspondences between the predetermined working type identification information and the position of the rotational-movement center E, controlled by the link rotational-movement center changing means 510. The link characteristic control means 670 controls the position of the rotational-movement center E by checking the working type identification information against the correspondence table. The working type identification information may be a combination of plural pieces of information, e.g. a combination of the board thickness, a working circumferential length, and the like.

The control system will be described. The working control means 610 is a device that controls the whole motor driven link press. It is composed of a computerized numerical control device and a programmable controller both controlled by the working program 650. The working control means 610 is provided with a control function of confirming, if the rotational-movement center E of the restraining link 8 has been changed, that the changed position has been fixed and then starting to drive the motor 13. This and other functions will be described.

The working control means 610 has link characteristic control means 670, change commanding means 620, change corresponding motor angle control means 630, and lock confirming and working permitting means 640. The change commanding means 620 may be a part or the whole of the link characteristic control means 670.

In response to a predetermined command from the working program 650, the change commanding means 620 recognizes the type of working to control the link rotational-movement center changing means 510 to change the rotational-movement center E of the restraining link 8 according to the type of working. The change commanding means 620 classifies working into two types including heavy load working and light load working. For the heavy load working, the rotational-movement center E is set at a position corresponding to a heavy load (the position shown in FIG. 21A). For the light load working, the rotational-movement center E is set at a position corresponding to a light load (the position shown in FIG. 21B). Further, the lock means 540 performs an unlocking operation before the link rotational-movement center changing means 510 is operated. It then performs a locking operation after the change has been completed. The change commanding means 620 may cause the link rotational-movement center changing means 510 to change the rotational-movement center E according to an operation of a switch 660 or to perform this changing operation according to either the command from the working program 650 or the operation of the switch 660.

To cause the link rotational-movement center changing means 510 to perform the changing operation, the change corresponding motor angle control means 630 provides such control as drives the motor 13 to rotate the crank shaft 3 through a predetermined angle. This predetermined angle is such that the crank shaft 3 is rotated so that the position of the ram 6 is not markedly changed after an operation of changing the position of the rotational-movement center E to cause the pivoting link 5 to pivot to elevate or lower the ram 6.

The lock confirming and working permitting means 640 inhibits the motor 13 from being driven before the link rotational-movement center changing means 510 changes the rotational-movement center E of the restraining link 8. The lock confirming and working permitting means 640 then permits the motor 13 to be driven after confirming that the changed position has been fixed. Specifically, the lock confirming and working permitting means 640 permits the motor 13 to be driven after confirming that the lock member 560 of the lock means 540 has engaged with the engaged portion 550 of the rotational moving member 520. The lock confirming and working permitting means 640 recognizes that the lock member 560 has engaged with the engaged portion, on the basis of a signal from detecting means 580 indicating the detection of movement of the lock driving means 570 to a predetermined position. The detecting means 580 may be omitted so that the driving of the motor 13 may be permitted a predetermined time after the change commanding means 620 has outputted a command for a lock operation to the lock driving means 570. The lock confirming and working permitting means 640 inhibits the motor 13 from being driven when, for example, the change commanding means 620 outputs an unlock command to the lock means 540.

A description will be given of a control operation performed by the working control means 610 to change the position of the rotational-movement center. For heavy load working, in response to a predetermined command from the working program 650 or a signal from the switch 660, the change commanding means 620 commands the link rotational-movement center changing means 510 to set the rotational-movement center E of the restraining link 8 at the heavy load corresponding position (shown in FIG. 21A). At this position, the ram displacement curve HA shown in FIG. 22 is obtained as described above. Accordingly, the ram 6 lowers at a low speed to enable high-quality punch working.

For light load working, in response to a predetermined command from the working program 650 or a signal from the switch 660, the change commanding means 620 commands the link rotational-movement center changing means 510 to set the rotational-movement center E of the restraining link 8 at the light load corresponding position (shown in FIG. 21B). At this position, the ram displacement curve HB shown in FIG. 22 is obtained. Accordingly, the ram 6 lowers at a high speed, thus enabling high-quality punch working.

To use the change commanding means 620 to cause the link rotational-movement center changing means 510 to perform a changing operation, the lock means 540 unlocks the rotational moving member 520 and then the actuator 530 rotationally moves the rotational moving member 520 through a predetermined angle. This rotational movement causes the different engaged portion 550 of the rotational moving member 520 to face the lock member 560. Subsequently, the lock means 540 engages the lock member 560 with the engaged portion 550 to lock the rotational moving member 520 so that the member 520 cannot be rotated. By thus using the lock means 540 to lock the rotational moving member 520, the rotational-movement center E of the restraining link 8 is prevented from being moved by a load or the like during working. The lock confirming and working permitting means 640 inhibits the working control means 610 from driving the motor 13 when the rotational moving member 520 is unlocked. It permits the motor 13 to be driven when the detecting means 580 detects that the lock means 540 has been brought into a locking condition. In this manner, the motor 13 is permitted to be driven for punch working after the position of the rotational-movement center E has been fixed. This prevents punch working from being carried out when the locking effect is insufficient or the rotational-movement center E is incompletely positioned. Therefore, safety is ensured. In connection with the above the changing operation, a description has been given only of a change from heavy load position to light load position. The same operations as those described above are performed to change the light load position to the heavy load position except that the rotational moving direction of the rotational moving member 52 is reversed.

Further, when the link rotational-movement center changing means 510 rotationally moves the rotational moving means 520, the change corresponding control means 630 causes the motor 13 to rotate the crank shaft 3 through a predetermined angle. That is, when the position of the rotational-movement center E at the proximal end of the restraining link 8 is changed, it must be changed on an arc around the third connecting portion P3 in order to change the position of proximal end of the restraining link 8 without elevating or lowering the ram 6. This is because the leading end of the restraining link 8 is connected to the third connecting portion P3 of the pivoting link 5. When the position is to be changed on such an arc, the configuration of the link rotational-movement center changing means 510 is limited. Consequently, this operation cannot be handled by the configuration according to this embodiment in which the support shaft 12 is eccentrically provided on the rotational moving member 520. The provision of the change corresponding motor angle control means 630 enables the position of the rotational-movement center E at the proximal end of the restraining link 8 to be changed by rotating the crank shaft 3 by an amount corresponding to the pivoting of the pivoting link 5 or the elevation or lowering of the ram 6 associated with the change, i.e. causing the motor 13 to rotate the crank shaft 3 through a predetermined angle, in spite of use of an arbitrary path for changing the position of the pivoting center E. Consequently, the operation of the link rotational-movement center changing means 510 is not limited, thus increasing the degree of freedom of design of the link rotational-movement center changing means 510. This results in the simple configuration in which the support point shaft 12 is eccentrically provided on the rotational moving member 520.

Figure 23A:
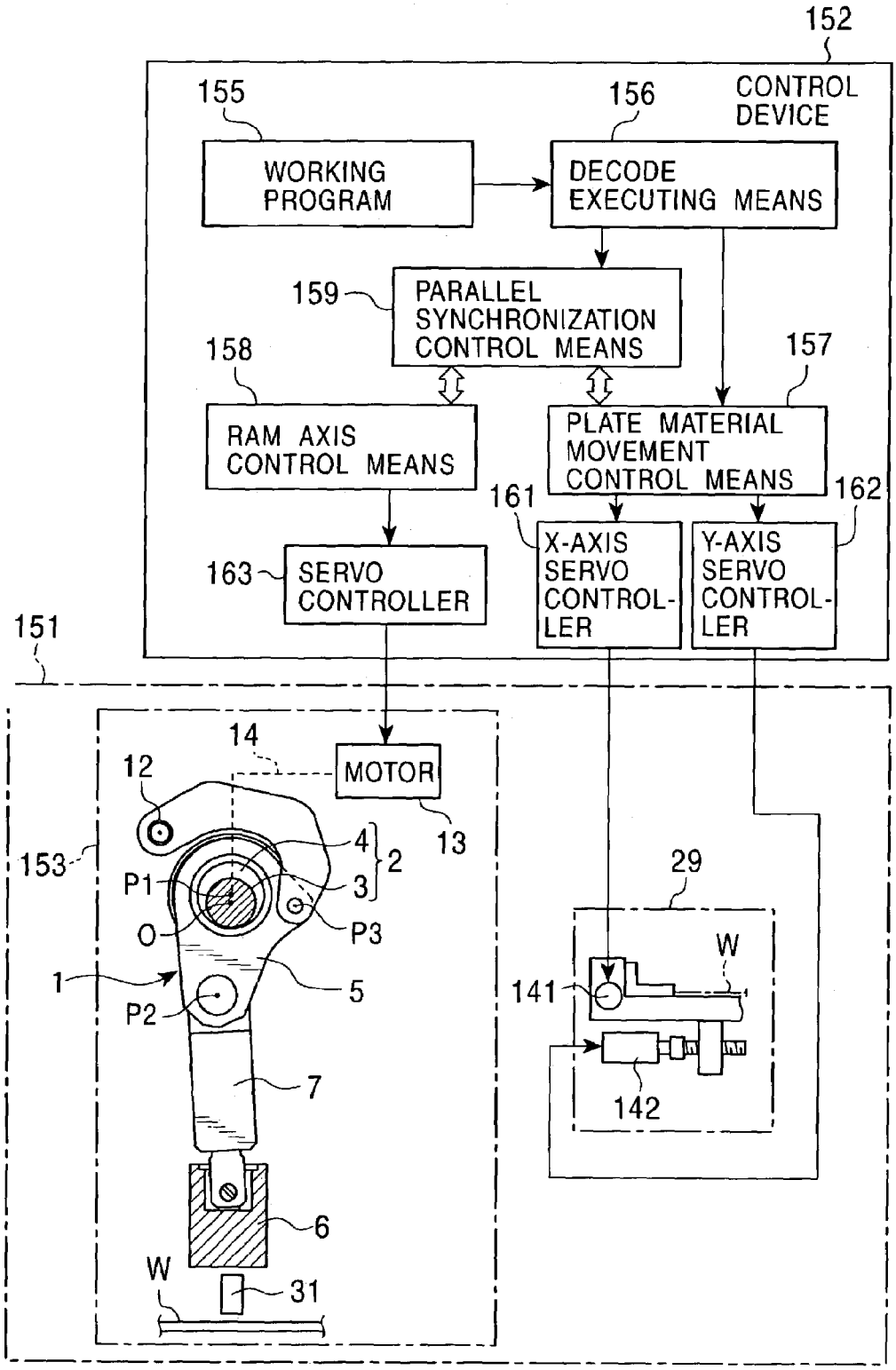
FIG. 23A is a diagram showing a conceptual configuration of a motor driven link press according to still another embodiment of the present invention.

Yet another embodiment of the present invention will be described below with reference to the drawings. As shown in FIG. 23, this motor driven link press is composed of a link press main body 151 that is a mechanical part and a control device 152 that controls the link press main body 151. The link press main body 151 comprises ram driving means 153 that drives the elevation and lowering of the tool driving ram 6 at a predetermined position, and plate material moving means 29 that moves a plate material as a workpiece below the ram 6. The ram driving means 153 is of a link type having the link mechanism 1.

In FIG. 23, the control device 152 is composed of a computerized numerical control device (NC device) and a programmable controller. It is of a program controlled type that decodes and executes a working program 155.

The control device 152 comprises plate material movement control means 157 that controls the plate material moving means 29, ram axis control means 158 that controls the motor 13 for the ram driving means 153, parallel synchronization control means 159 that synchronously controls both control means 157, 158, sequence control means (not shown in the drawings) that controls various types of sequence control of the link press main body 151, and decode executing means 156 that decodes the working program 155 and provides commands from the working program 155 to the control means 157, 158, 159, - - - .

The working program 155 is stored in a program memory (not shown in the drawings) of the control device 152 or is externally loaded into the decode executing means 156. The working program 155 is described in terms of NC codes or the like. It contains the descriptions of X- and Y-axis movement commands that are plate material movement commands to cause the plate material moving means 29 to move the plate material in the directions of the X- and Y-axes, respectively, punch commands to elevate or lower the ram driving means 153, sequence commands (not shown in the drawings) to control the sequence operation of each portion of the link press main body 151, and other commands. The movement command for each axis and the punch command are provided, for example, as one block commands. Further, the working program 155 has information on the board thickness in its attribute information storage section.

Figure 23B:
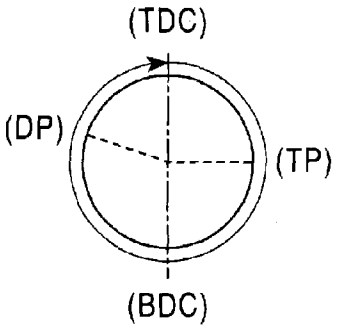
FIG. 23B is a diagram showing a crank operation of this link press.
Figure 23C:
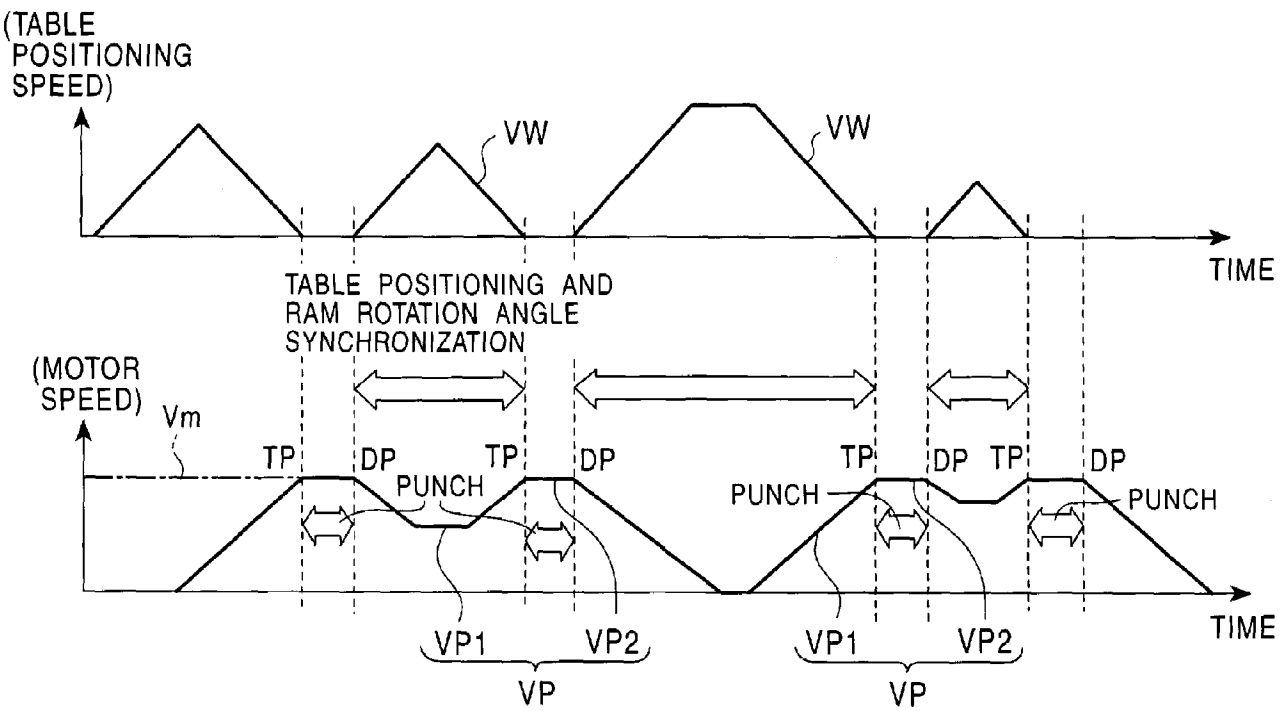
FIG. 23C is a time chart for a plate material movement speed and a ram axis motor speed in this link press.

The plate material movement control means 157 controls an X- and Y-axis servomotors 141, 142 in the plate material moving means 29 via servo controllers 161, 162 for the respective axes. The plate material movement control means 157 provides trapezoidal control such that a plate material moving speed exhibits a trapezoidal speed curve VW comprising an acceleration section with a constant acceleration, a constant speed section, and a deceleration section with a constant deceleration as shown in FIG. 23C. If the moving distance of the plate material is short, the speed is reduced before reaching that of the constant-speed movement, resulting in a triangular speed curve VW. In this figure, the plate material moving distance is indicated by the area of trapezoidal or triangular portion of the plate material movement speed curve VW.

The plate material control means 157 gives a movement command by, for example, outputting pulses. It changes the speed by changing a pulse distribution frequency. In this case, the servo controllers 161, 162 are digital servomechanisms that control a motor current according to an input pulse train.

Figure 27:
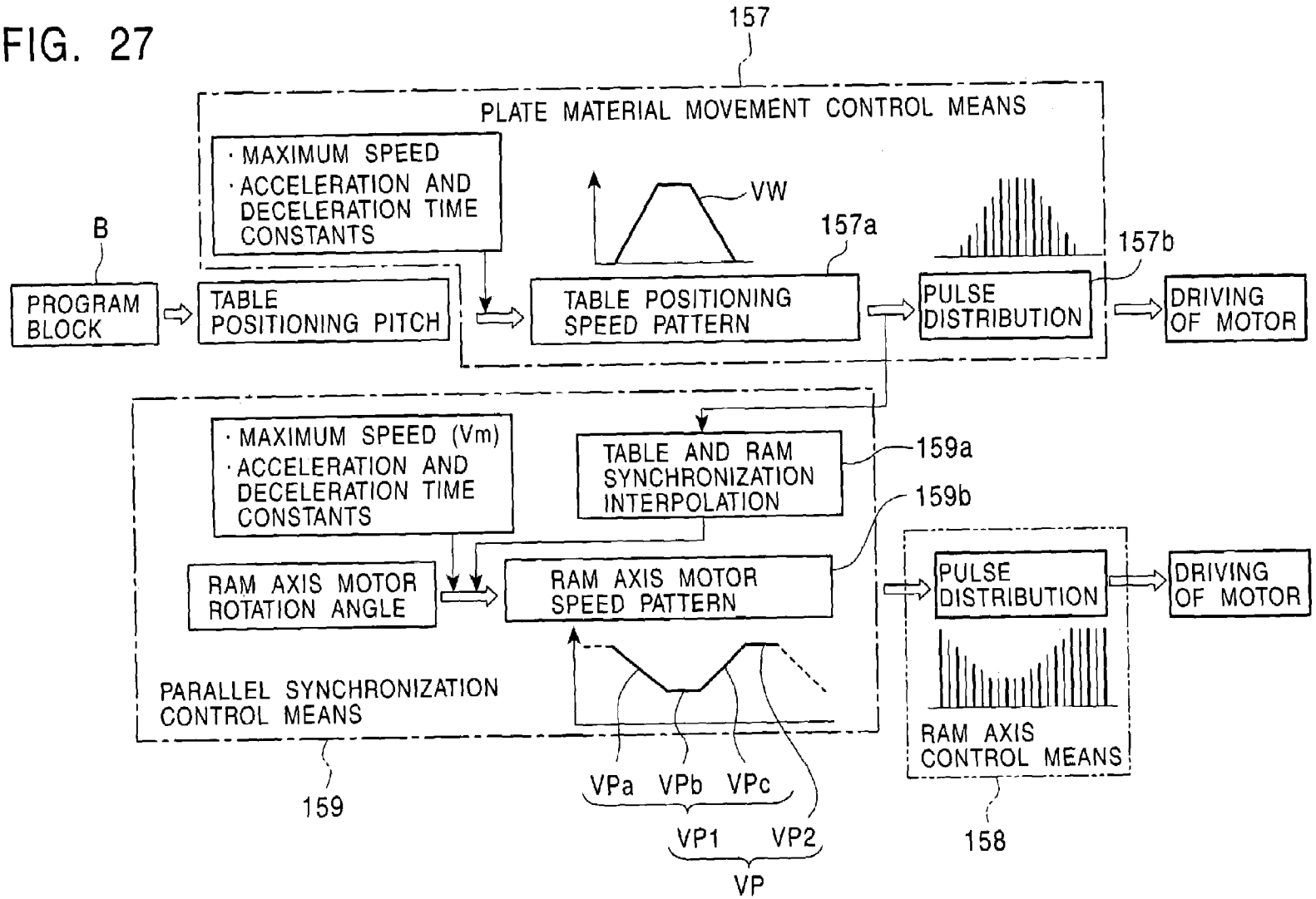
FIG. 27 is a diagram illustrating specific examples of plate material moving means, ram axis control means, and parallel synchronization control means in this control device.

Specifically, the plate material movement control means 157 is composed of a speed pattern generating section 157*a* and a pulse distributing section 157*b* as shown in FIG. 27. The speed pattern generating section 157*a* is means for generating a speed pattern corresponding to the above trapezoidal or triangular speed curve VW, according to a preset maximum speed and preset acceleration and deceleration time constants as well as the plate material moving distance (in other words, a table positioning pitch). The pulse distributing section 157*b*is means for distributing pulses according to the set speed curve VW in order to drive the motor. In FIG. 27, a change in pulse distribution frequency is indicated by the height of the pulse.

In this embodiment, the plate material movement control means 157 generates a speed pattern for each of the X- and Y-axes. However, it may generate a speed pattern so as to synchronize movements along the X- and Y-axes.

In FIG. 23, the ram axis control means 158 controls the motor 13 for the ram driving means 153 via a servo controller 163. The ram axis control means 158 controls the ram speed by rotating the motor 13 in one direction and controlling the rotation speed of the motor 13. Specifically, the ram axis control means 158 distributes pulses according to a given ram rotation speed pattern VP in order to drive the motor as shown in FIG. 27.

Figure 24:
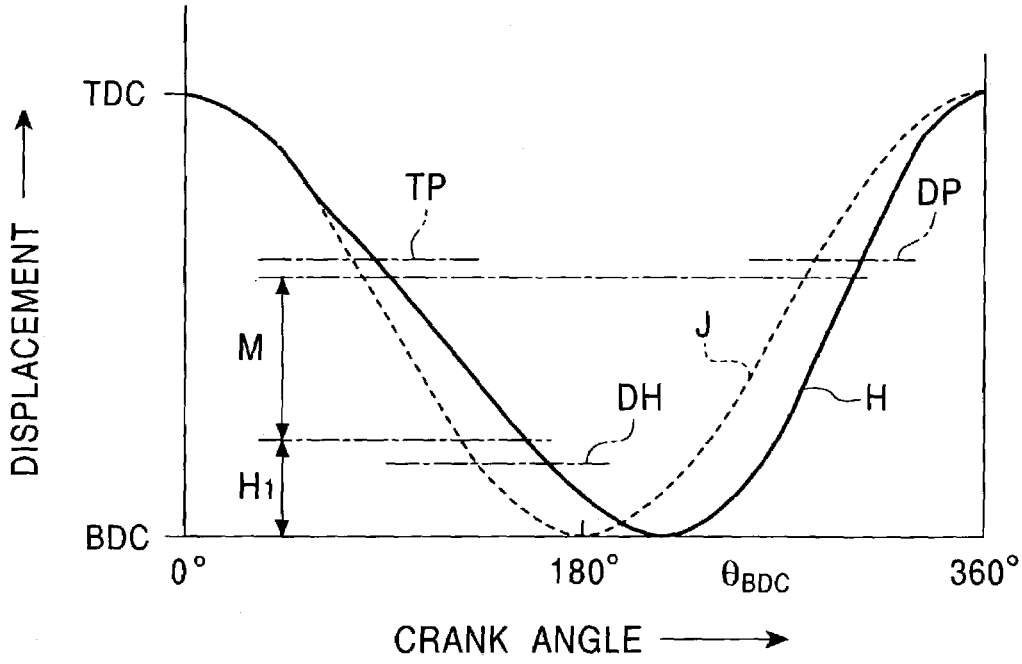
FIG. 24 is a graph showing the relationship between the crank angle and ram displacement in this link mechanism at the time when the motor is rotated in a forward and backward directions, respectively.

In FIG. 23, the parallel synchronization control means 159 gives commands to the ram axis control means 158 so that the operation in which the punch tool 31 driven by the ram 6 to elevate and lower moves from a height DP (FIG. 24) corresponding to a time immediately after it has left the top surface of the plate material, through the top dead center TDC to a height TP close to the top surface of the plate material is in parallel with the movement of the plate material from start till arrival at the next working point, the movement being effected by the plate material moving means 29. As shown in a specific example later, the parallel synchronization control means 159 controls the speed by maintaining a constant acceleration both during acceleration and during deceleration. The parallel synchronization control means 159 provides such control as avoids zeroing the speed of the motor 13 if the time required for the plate material movement from start till arrival at the next working point is shorter than a set time. If any maximum speed and acceleration and deceleration time constants have been specified for the motor 13, this set time is determined by these maximum speed and acceleration and deceleration time constants.

Specifically, the parallel synchronization control means 159 has a table and ram synchronization interpolating section 159*a* and a generating section 159*b* that generates a ram axis motor speed pattern VP, as shown in FIG. 27. The table and ram synchronization interpolating section 159*a* is means for calculating, from the plate material moving speed curve VW generated by the plate material movement control means 157, the time required for the plate material movement from start till arrival at the next working point, the movement being effected by the plate material moving means 29. The plate material moving time is required for movement along both X- and Y-axes. If the moving time on the X-axis is different from the moving time on the Y-axis, the longer is determined to be the plate material moving time.

The ram axis motor speed pattern generating section 159*b* is means for generating the speed pattern VP of the motor 13 for one rotation of the crank shaft 2. The motor speed pattern VP is composed of a motor speed pattern VP1 for plate material non-contact corresponding to the operation in which the punch tool 31 driven by the ram 6 to elevate and lower moves from the height DP (FIG. 24) corresponding to the time immediately after it has left the top surface of the plate material, through the top dead center TDC to the height TP close to the top surface of the plate material W, and a motor speed pattern VP2 for plate material contact following the motor speed pattern VP1 and corresponding to the operation in which the punch tool 31 moves from the height TP close to the top surface through the bottom dead center BDC to the height DP corresponding to the time immediately after the leaving.

Figure 28:
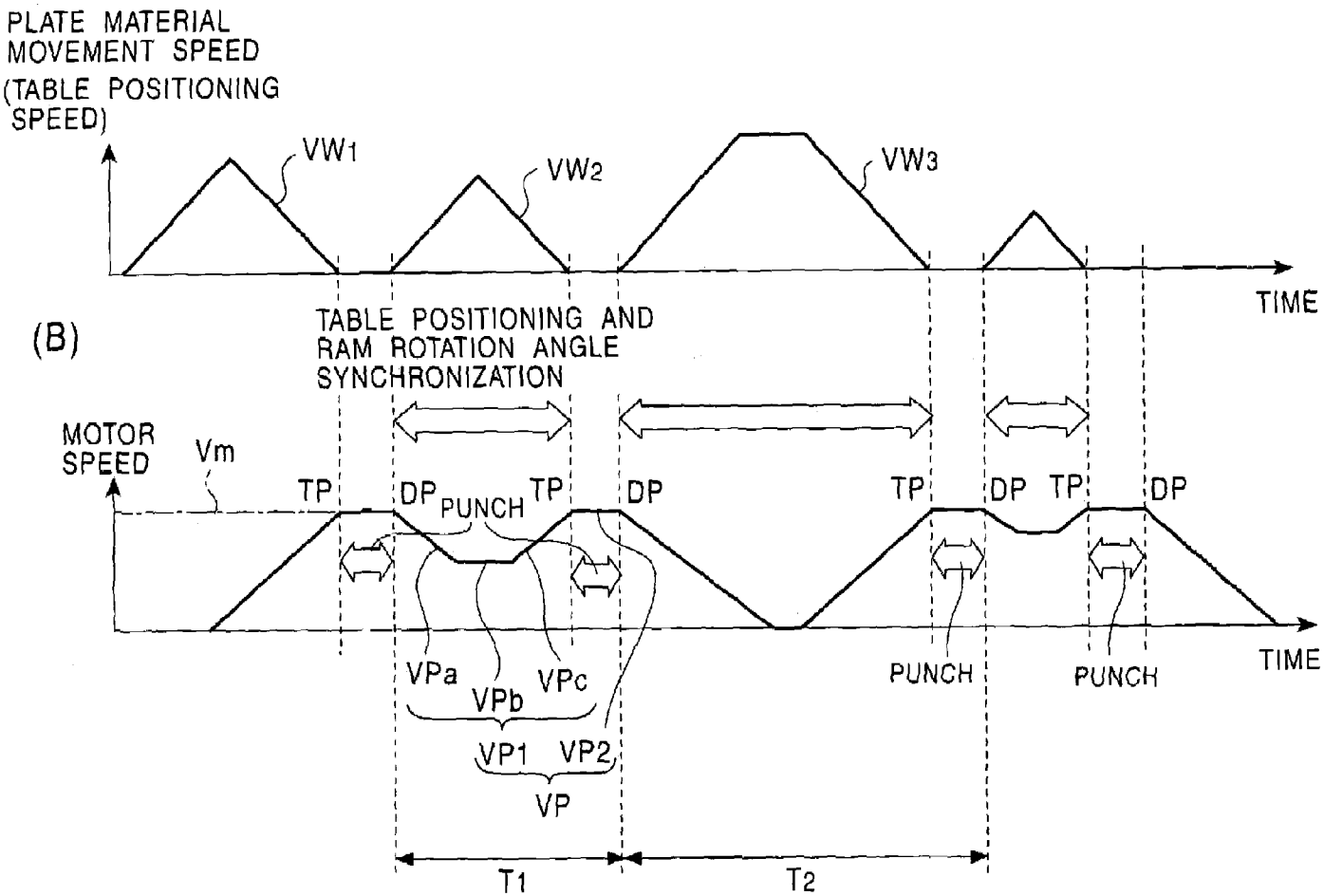
FIG. 28 is a time chart of a plate material moving speed and a ram axis motor speed in this link press.

The ram axis motor speed pattern generating section 159*b* generates the motor speed pattern VP1 for plate material non-contact so that the operation in which the punch tool 31 moves from the height DP corresponding to the time immediately after the leaving through the top dead center RDC to the height TP close to the top surface is performed in the plate material moving time obtained by the table and ram synchronization interpolating section 159*a*. That is, the motor speed pattern VP1 is generated so that the plate material moving time equals the time required for a ram operation from the height DP corresponding to the time immediately after the leaving to the height TP close to the top surface. The motor speed pattern VP1 is generated so that the speed is the maximum one Vm at the height DP (FIG. 28) corresponding to the time immediately after the leaving, subsequently gradually decreases, then maintains a constant speed, and increases again to the maximum one (Vm) at the height TP close to the top surface. This generation is carried out according to the preset maximum speed Vm and acceleration and deceleration time constants. The acceleration and deceleration time constants have, for example, a fixed value. If the acceleration an deceleration time constants are fixed, the ram axis motor speed pattern VP1 for plate material non-contact constitutes a speed curve which is basically inversely trapezoidal and which is composed of a deceleration portion VPa, a constant-speed portion VPb, and an acceleration portion VPc. If the plate material moving time is short, then the ram operation time is short. Accordingly, the speed pattern VP1 is free from the constant-speed pattern VP*b* and is thus V-shaped. The ram axis motor speed pattern VP2 for plate material contact indicates the fixed maximum speed Vm. The maximum speed Vm is properly set at a value suitable for punch working.

If the ram axis motor speed pattern generating section 159*b* generates the motor speed pattern VP1 as described above, when the plate material moving time is long, the motor speed decreases to zero. This is because the acceleration and deceleration time constants are fixed. The speed is maintained at zero and then increased. The time required for the maximum speed Vm to decrease to zero corresponds to the above set time. If the time required for the plate material movement from start till arrival at the next working point is shorter than the above set time, the parallel synchronization control means 159 provides such control as avoids zeroing the speed of the motor 13.

To start punch working when the ram is stopped at the top dead center or the like, the ram axis motor speed pattern generating section 159*b* generates a speed pattern in which, during the first single ram operation, the ram 6 moves from the angle of rotation of the motor set during stoppage through the height TP close to the top surface and the top dead center TDC to the height DP corresponding to the time immediately after the leaving.

Further, the parallel synchronization control means 159 provides such control as synchronizes the start of the plate material movement effected by the plate material moving means 29 with the ram operation. This synchronization is carried out by providing a signal to the plate material movement control means 157 to start the plate material movement when the punch tool 31 reaches the height DP corresponding to the time immediately after the leaving after having wrought the plate material W. This synchronization control is executed, for example, by the table and ram synchronization interpolating section 159*a*. An appropriate detecting means provided in the link mechanism 1, the ram 6, or the like can detect that the punch tool 31 has reached the height DP corresponding to the time immediately after the leaving.

The height DP (FIG. 24) corresponding to the time immediately after the leaving and the height TD close to the top surface are each a height position located a set excess distance above the surface of the plate material W. The set excess distance can be arbitrarily set. The set excess distance for the height DP corresponding to the time immediately after the leaving may have a value different from that of the set excess distance for the height TD close to the top surface. The position of surface of the plate material W is obtained from information on the thickness of the plate material set in the working program 155. The surface position of the plate material W may be, for example, that of the thickest plate material wrought by this motor driven link press and may have a fixed value.

A pre-reading function of the working program 155 provided in the plate material movement control means 157, parallel synchronization control means 159, or decode executing means 156 is used for the generation of a plate material moving speed pattern by the plate material movement control means 157 as well as the generation of a ram axis motor speed pattern by the parallel synchronization control means 159. For example, while the plate material movement control means 157 or the ram axis control means 158 is distributing pulses according to a block of the working program 155 being executed, a plate material moving speed pattern or a ram axis motor speed pattern is generated in response to a command in a pre-read block of the working program 155.

Figure 26:
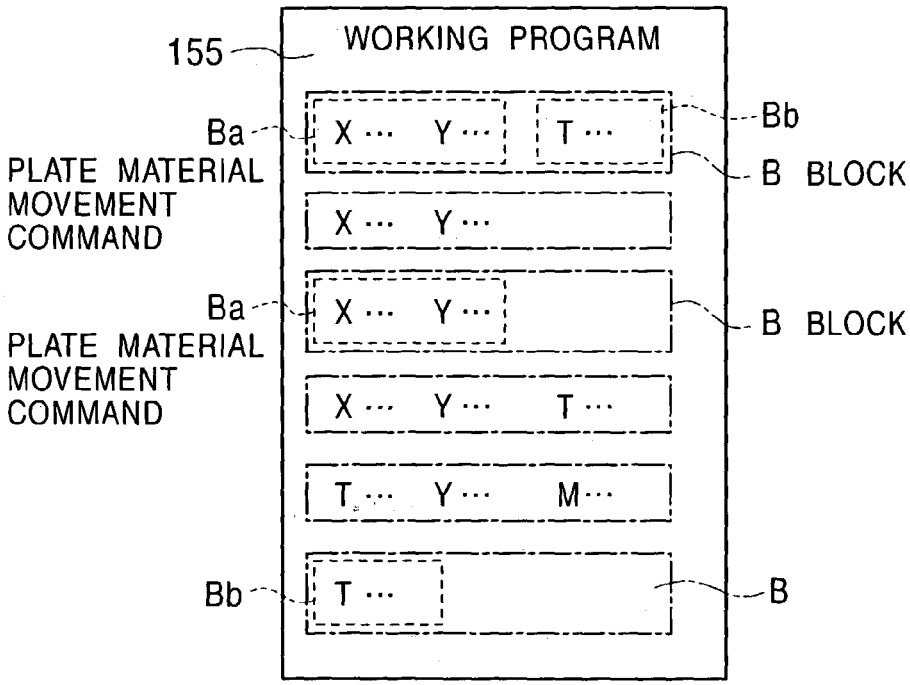
FIG. 26 is a diagram showing an example of structure of a working program executed by this control device.

FIG. 26 shows an example of structure of the working program 155. The working program 155 is composed of a list of sequentially executed blocks B as shown in FIG. 26. One or more commands such as a plate material movement command Ba or a tool command Bb are described in each block B. The plate material movement command Ba describes movement following a code (X, Y, or the like) indicative of a moving direction. For a punch press, in most cases, the plate material movement command Ba causes a portion of the plate material to be punched to be moved to the ram position. Thus, in this example, the block B containing the plate material movement command Ba means that a punch operation is performed after the plate material has been moved. Thus, for the blocks B that do not cause any punch operations to be performed after the movement of the plate material, the plate material movement command Ba is followed by a command expressed by an M code or the like and which inhibits the punch operation. Accordingly, the decode executing means 56 in FIG. 23 considers the blocks B containing the plate material movement command Ba (FIG. 26) from the working program 155 to contain a punch command unless the non-punch command is added to them.

Figure 25:
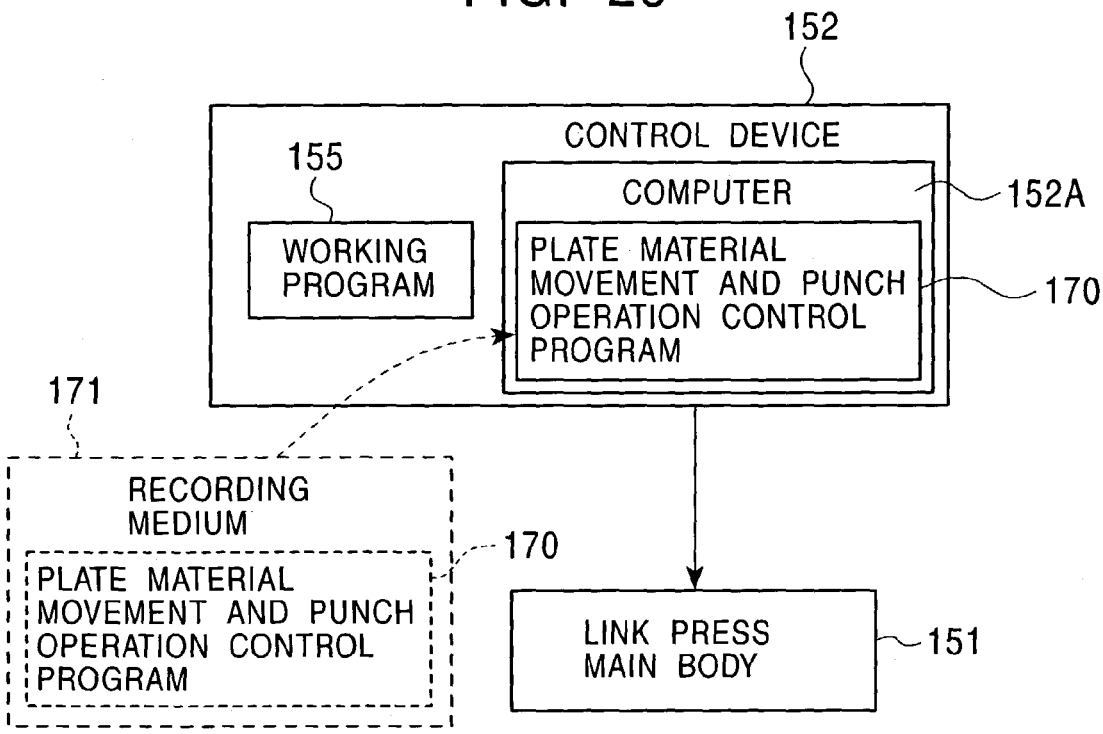
FIG. 25 is a block diagram showing the relationship between a control device and its control program in this link press.

The plate material movement control means 157, ram axis control means 158, and parallel synchronization control means 159 of the control device 152, described with reference to FIG. 23, are composed of a computer 152A constituting the control device 152 and a plate material movement and punch operation control program 170 as shown in FIG. 25. The plate material movement and punch operation control program 170 may be stored in a storage medium 171 from which the program 170 may be read by a storage medium reading device (not shown in the drawings) of the computer 152A. The storage medium 171 is, for example, a compact disk or a magneto optic disk. Alternatively, the plate material movement and punch operation control program 170 may be stored in another computer that may provide the program 170 to the computer 152A via a communication line.

A description will n given of the relationship between the plate material movement and the ram operation, both controlled by the control device 152. It is assumed that while the plate material is being moved as shown by a speed curve VW1 at the left end of FIG. 28A, the decode executing means 156 (FIG. 23) pre-reads a block B from the working program as shown in FIG. 27. At this time, the table positioning pitch, i.e. the plate material moving distance to the next working point, is decoded from the block B. On the basis of the set maximum speed and acceleration and deceleration time constants, the positioning speed pattern generating section 157*a* of the plate material movement control means 157 generates a speed curve VW according to which the plate material is moved over the decoded plate material moving distance. The speed curve VW is normally trapezoidal but is triangular if the moving distance is short. The plate material movement control means 157 subsequently uses a predetermined timing to cause the pulse distributing section 157*b* to distribute pulses according to the generated speed curve VW to allow the plate material moving means 29 to move the plate material. This movement is based on the second speed curve VW2 from the left end of FIG. 28A. The predetermined timing is a point of time at which the detecting means (not shown in the drawings) detects that, after the last working carried out by elevating and lowering the ram 6, the punch tool 31 has reached the height DP corresponding to the time immediately after the punch tool 31 has left the plate material W.

Once the positioning speed pattern generating section 157*a* generates the speed curve VW2, the parallel synchronization control means 159 uses the table and ram synchronization interpolating section 159*a* to calculate the time required for the plate material movement. The parallel synchronization control means 159 also uses the ram axis motor speed pattern generating section 159*b* to generate a motor speed pattern VP for the ram axis. The motor speed pattern VP is a combination of the motor speed pattern VP1 for plate material non-contact corresponding to the operation in which the punch tool 31 moves from the height DP (FIG. 24) corresponding to the time immediately after it has left the top surface of the plate material, through the top dead center TDC to the height TP close to the top surface of the plate material W, and the motor speed pattern VP2 for plate material contact following the motor speed pattern VP1 and corresponding to the operation in which the punch tool 31 moves from the height TP close to the top surface through the bottom dead center BDC to the height DP corresponding to the time immediately after the leaving. In FIG. 28B, the motor speed pattern VP corresponds to a time T1.

The motor speed pattern VP1 for plate material non-contact is generated so that the operation from the height DP corresponding to the time immediately after the leaving to the height TP close to the top surface is performed exactly in the plate material movement time. This generation is carried out according to the preset maximum speed Vm and acceleration and deceleration time constants. The motor speed pattern VP1 is generated so that the speed is the maximum one Vm at the height DP (FIG. 28) corresponding to the time immediately after the leaving, subsequently gradually decreases, then maintains a constant speed, and increases again to the maximum one Vm at the height TP close to the top surface.

The ram axis motor speed pattern VP1 for plate material non-contact is basically inversely trapezoidal. If the plate material moving time is short, then the ram operation time is short. Accordingly, the speed pattern VP1 is free from the constant-speed pattern VPb and is thus V-shaped. The ram axis motor speed pattern VP2 for plate material contact indicates the fixed maximum speed Vm.

The thus generated ram axos motor speed pattern VP is outputted to the ram control means 158. After the ram axis motor speed pattern VP for the last punch operation has ended, the ram axis control means 158 drives the motor by distributing pulses according to the generated ram axis motor speed pattern VP. The last ram axis motor speed pattern VP ends when the punch tool 31 reaches, after punch working, the height DP corresponding to the time immediately after the punch tool 31 has left the plate material W. Accordingly, control based on the current ram axis motor speed pattern VP is carried out after the height DP corresponding to the time immediately after the leaving. Such control is repeated while sequentially pre-reading the blocks B of the working program 155.

Such control causes the operations described below to be performed. That is, the ram driving motor 13 is always rotated in one direction. The crank shaft 2 of the link mechanism 1 is thus always rotated in one direction as shown in FIG. 23B. The ram 6 executes punch working on the plate material W while lowering from the height TD close to the top surface to the bottom dead center BCD. At the height TD close to the top surface, the ram speed is preferable for punch working. This preferable speed is maintained during lowering to the bottom dead center BDC and during elevation from the bottom dead center BDC to the height DP corresponding to the time immediately after the leaving. Further, during these operations, the plate material W remains stopped.

Once the punch tool 31 elevates to the height DP corresponding to the time immediately after the leaving, the plate material moving means 29 starts moving the plate material W. Once the plate material movement is completed, the punch tool 31 reaches the height TD close to the top surface. In this manner, during the plate material movement, synchronous control is provided so that a ram operation is performed so as not to bring the tool into contact with the plate material W. This eliminates useless standby time to minimize the cycle time. Further, the cycle time can be reduced without reciprocating the crank shaft 3.

Figure 29:
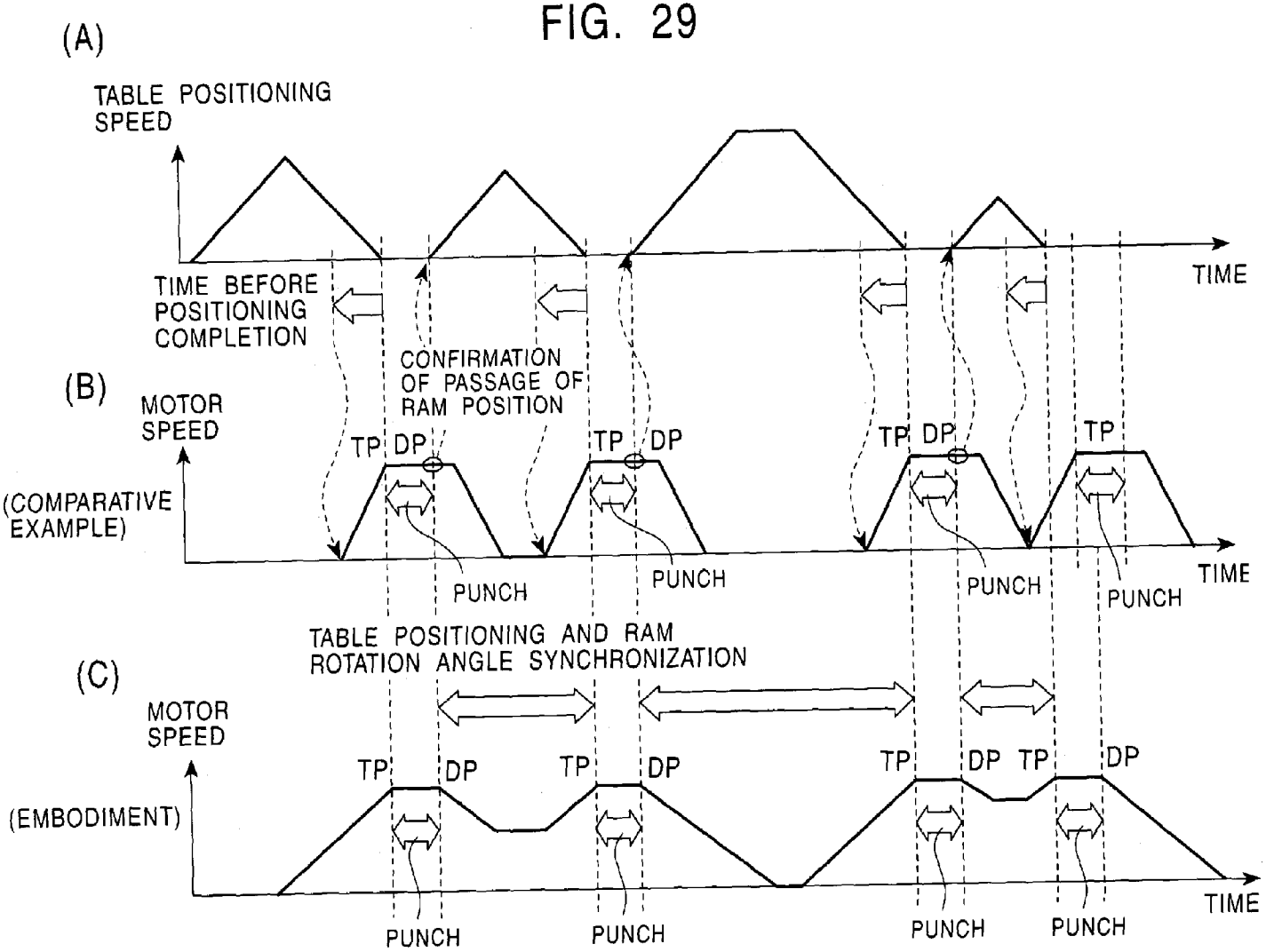
FIG. 29 is a time chart showing the plate material moving speed and ram axis motor speed in this link press together with a comparative example.

Further, after the crank shaft 3 has been rotated in one direction to elevate the tool from the height DP corresponding to the time immediately after the leaving and before the tool reaches the height TD close to the top surface, the ram axis control means 158 attempts to avoid stopping the ram 6 according to the speed pattern VP provided by the parallel synchronization control means 159. That is, the parallel synchronization control means 159 provides a speed pattern VP that avoids zeroing the speed of the motor 13 if the time required for the plate material movement is shorter than the set time. This reduces an acceleration load on the punch driving servomotor 13, thus minimizing acceleration and deceleration energy. This in turn serves to accomplish a reduced cycle time, i.e. an increased hit rate and the saving of punch driving energy. For example, as shown in the comparative example in FIG. 29B, compared to such control as starts a punch operation a predetermined time before the stoppage of the plate material movement, high acceleration or deceleration is not required to drive the ram. This prevents the driving of the motor from consuming more energy for acceleration and deceleration.

In generating a motor speed pattern VP, the parallel synchronization control means 159 sets a constant acceleration both for acceleration and for deceleration. Consequently, the calculation of a motor speed pattern VP by the computer 152A, constituting the control device 152, constitutes a light load. The calculation can thus by promptly executed by a relatively simple computer 152A.

Further, the motor speed pattern VP is trapezoidal and has the constant-speed pattern portion VPb. Consequently, the speed does not change rapidly, and the ram 6 can be smoothly elevated and lowered while no punch operations are performed. Therefore, vibration and impact can be weakened.

In the above embodiment, the motor speed pattern VP is trapezoidal so as to accomplish linear acceleration and deceleration. However, the motor speed pattern VP may be adapted for curved acceleration and deceleration (so-called S-shaped acceleration and deceleration).

Still another embodiment of the present invention will be described below with reference to the drawings.

Figure 30:
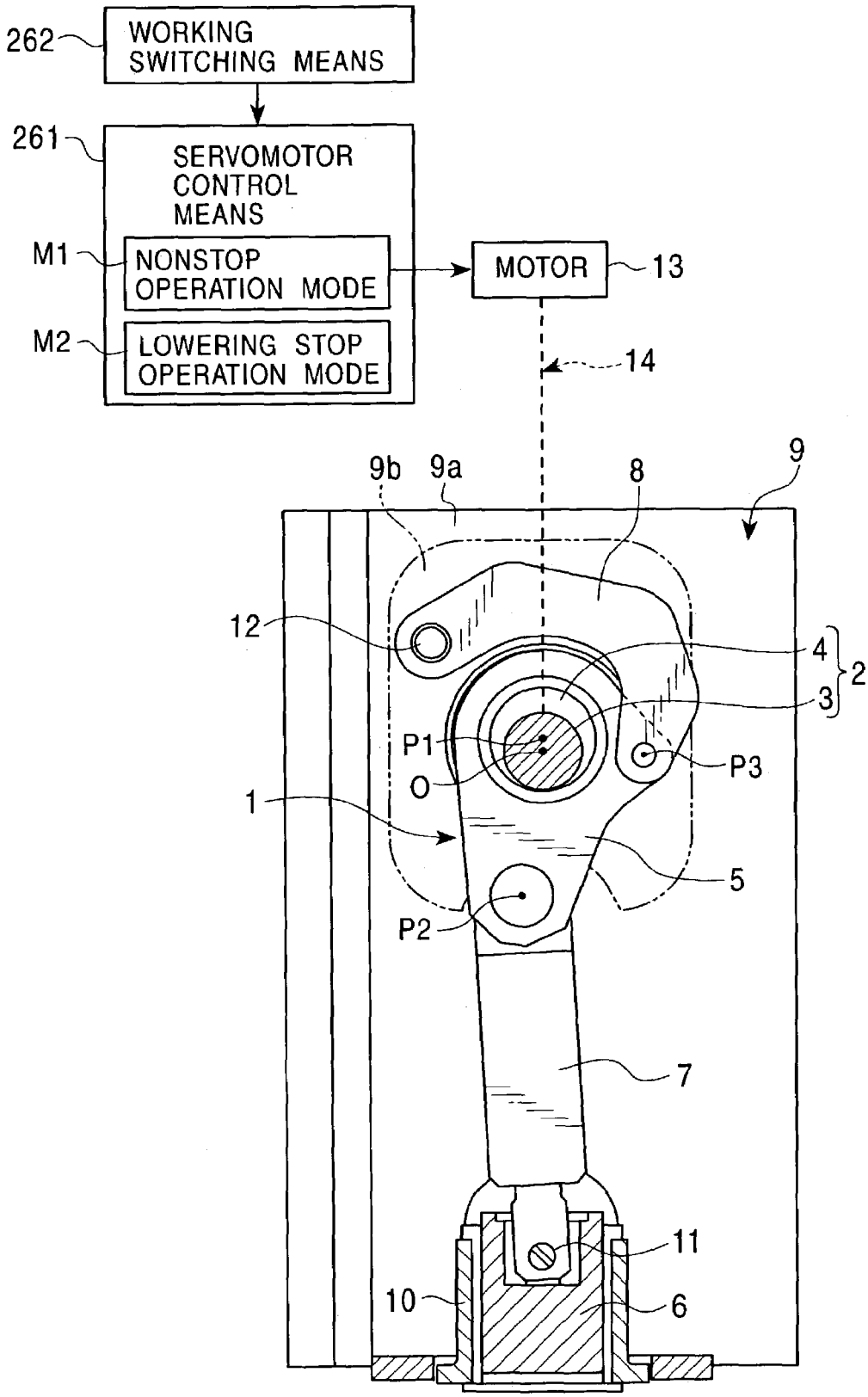
FIG. 30 is an exploded front view of a servomotor driven link press according to still another embodiment of the present invention.

FIG. 30 is an exploded front view of a link mechanism in this servomotor driven link press.

FIGS. 32A to 32D show various examples of tools used in this servomotor driven link press and driven by the ram 6.

Figure 32A:
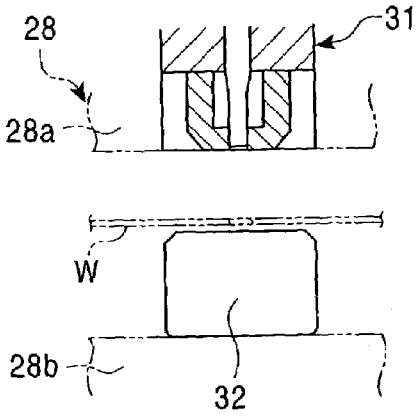
FIGS. 32A to 32D are exploded front views showing tools that carry out various types of working using this servomotor driven link press, respectively.

FIG. 32A shows an example of a punch working tool, the punch tool 31 and die tool 32.

Figure 32B:
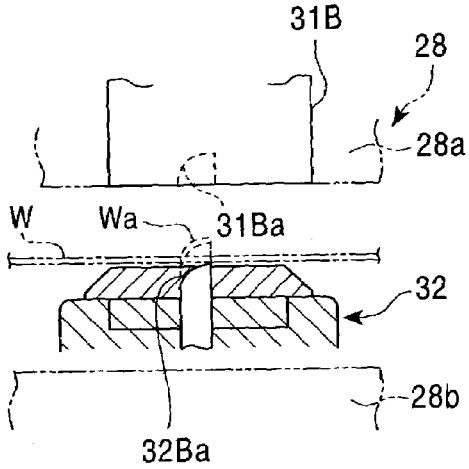

FIG. 32B shows a forming tool. An upper tool 31B has a concave forming-die surface 31Ba. A lower tool 32B has a convex forming-die surface 32Ba. The upper tool 31B is lowered by the ram 6 (FIG. 1) to form a formed portion Wa on the plate material workpiece W between the forming-die surfaces 31Ba, 32Ba of the upper and lower tools 31B, 32B.

Figure 32C:
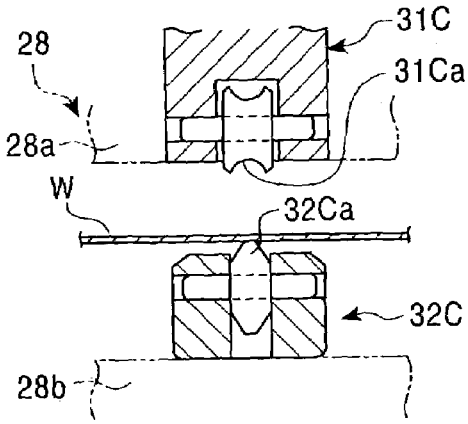

FIG. 32C shows an example of a rotary tool. An upper tool 31C and a lower tool 32C have a working rollers 31Ca, 32Ca, respectively, that can each be rotated around its axis orthogonal to the central axis of the tool. The upper tool 31C is lowered to a predetermined height position by the ram 6 to sandwich the plate material workpiece W between both working rollers 31Ca, 32Ca. A groove-like formed portion is thus formed in the plate material workpiece W. The working rollers 31Ca, 32Ca may sandwich the plate material workpiece W between themselves to cut it.

Figure 32D:
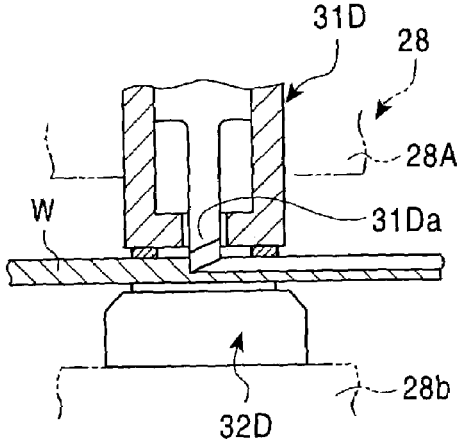

FIG. 32D shows an example of a cut working tool. An upper tool 31D has a cutting tool 31Da, and a lower tool 32D is a table on which the plate material workpiece W is placed.

The upper tool 31D is lowered to a predetermined height position by the ram 6 so that the cutting tool 31Da cuts into the plate material workpiece W down to the middle of its board thickness. Then, the plate material workpiece W is fed to cut a groove Wb in the plate material workpiece W.

The tools 31B to 31D and 32B to 32D are installed on the above described tool supporting means 28. For example, the tools 31B to 31D are installed on the turret 28*a*, and the tools 32B to 32D are installed on the turret 28*b*, the turrets 28*a*, 28*b* constituting the tool supporting means 28.

The control system will be described with reference to FIG. 30. This servomotor driven link press has servomotor control means 261 for controlling the servomotor 13 to stop the ram 6 at an arbitrary position within an elevating and lowering stroke of the ram 6. The servomotor control means 261 is composed of, for example, a computer constituting a numerical control device or the like which controls the whole servomotor driven link press. The servomotor control means 261 can switch the operation of the servomotor 13 between nonstop operation mode M1 in which the servomotor 13 is not stopped while the ram 6 is lowering and a lowering stop operation mode M2 in which the servomotor 13 is stopped while the ram 6 is lowering. Working switching means 262 is provided to supply the servomotor control means 261 with a command to switch the operation of the servomotor 13 between the nonstop operation mode M1 and the lowering stop operation mode M2. The working switching means 262 may be composed of, for example, a computer constituting the above described numerical control device or a switch provided on an operation panel.

In the lowering stop operation mode M2, while the servomotor 13 is being rotated in a rotating direction in which the ram 6 moves at a lower speed during lowering than during elevation owing to the characteristics of the link mechanism 1, the servomotor control means 261 stops the servomotor 13 while the ram 6 is lowering to stop the ram at an arbitrary position within its elevating and lowering stroke. Further, in the lowering stop operation mode M2, after the stoppage, the servomotor is rotated in the opposite direction. That is, the motor is stopped and reversely rotated before the ram reaches the bottom dead center. After this reversal, when the ram 6 reaches the top dead center TDC or a predetermined elevated position, the motor is reversely rotated again, that is, it is switched to the original rotating direction.

This servomotor driven link press uses the servomotor 13 as a driving source and can thus stop the ram 6 at an arbitrary position. Because of these characteristics of the motor and the use as motor control means of the servomotor control means 261, which controls the servomotor 13 to stop the ram 6 at an arbitrary position within its elevating and lowering stroke, this embodiment can stop the ram 6 at an arbitrary position to carry out various types of working, though it is of a link type. For example, it is possible to execute the forming in FIG. 32B, the working with the rotary tools 31C, 32C in FIG. 32C, or the cutting of the groove Wb with the cutting tool 31D*a* in FIG. 32D. If the forming in FIG. 32B is carried out, it is possible to change the protruding height of the formed portion Wa formed on the plate material workpiece W by controlling the stopped position of the ram 6 to change the lowering stopped position of the upper tool 31B. In this case, after the ram 6 has been stopped, the rotating direction of the servomotor 13 is reversed to elevate the ram 6.

If any of these types of working is carried out in which the ram 6 is stopped during lowering, the ram 6 lowers by only a short distance per unit rotation of the servomotor 13 because it is stopped during lowering operation in which it moves at a lower speed. Thus, the stopped position of the ram 6 can be more precisely controlled, thus enabling control within smaller ranges and thus more sophisticated working.

Figure 31:
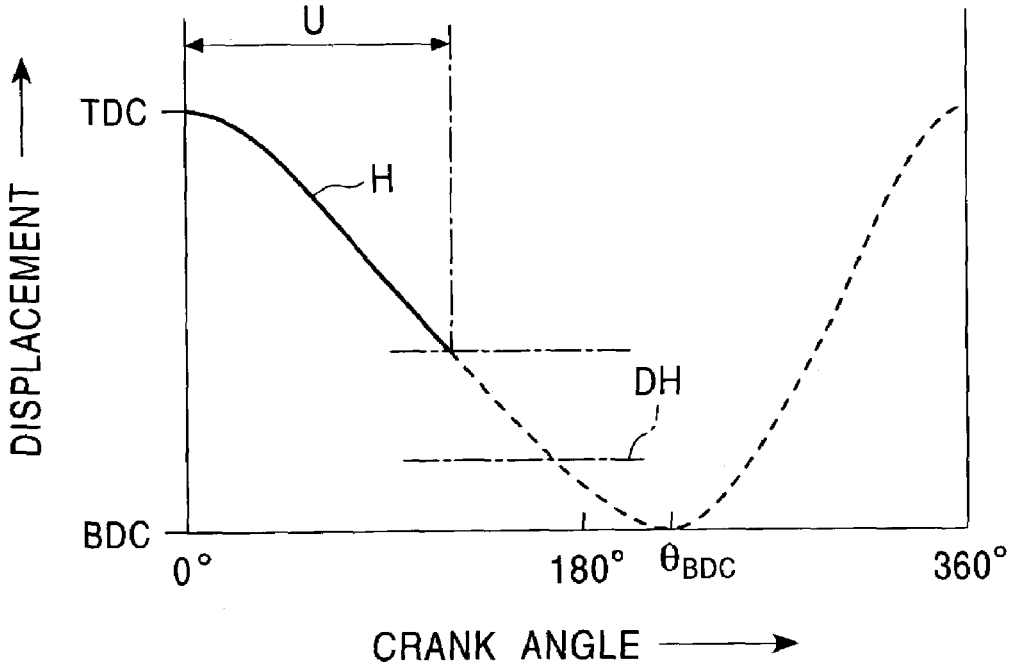
FIG. 31 is a graph showing the relationship between the crank angle and ram displacement in the case in which this link mechanism is stopped during lowering.

If working is carried out in which the ram 6 is stopped during lowering, then after the stoppage, the servomotor control means 261 provides such control as reverses the rotating direction of the servomotor 13. In this case, as shown in FIG. 31, the servomotor 13 is reciprocated in a section U corresponding to a part of one rotation of the servomotor 13. This enables working in which the ram is not lowered to the bottom dead center. It is also possible to carry out working in which the ram 6 is allowed to stand by at a predetermined standby height instead of elevating to the top dead center.

By switching the operation mode of the servomotor control means 261, the working switching means 262 can switch the type of working between the one in which the ram 6 is stopped during lowering and the one in which the ram 6 is not stopped during lowering. In this manner, control can be provided so as to freely switch among these types of working.

The use of the servomotor 13 enables to motor speed to be freely changed. The speed can also be changed during an elevating and lowering stroke of the ram 6, enabling working to be accomplished according to various requirements. That is, a speed curve based on operations of a link mechanism composed of the crank member 2, pivoting link 5, restraining link 8, and the like is used as a basic speed curve observed if the servomotor 13 is rotated at a uniform speed, and the motor speed is varied. Then, for example, the speed at which the punch tool 31 contacts with the plate material workpiece W is reduced to make operations more silent. Alternatively, the elevating speed can be further increased.

Figure 33:
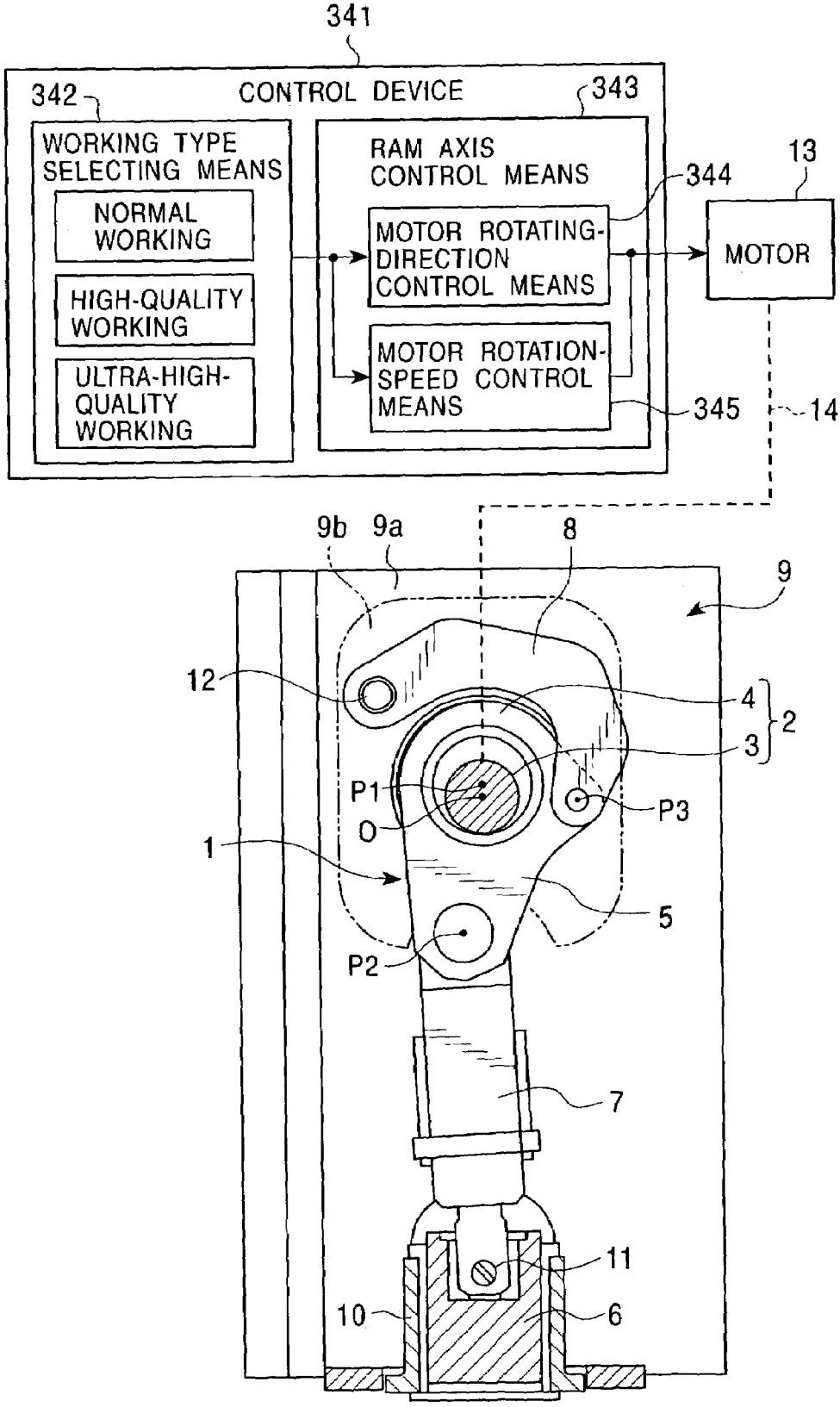
FIG. 33 is a combination of an exploded front view of a link mechanism in a motor driven link press according to further another embodiment of the present invention and a block diagram showing a conceptual configuration of a control system.

Further another embodiment of the present invention will be described with reference to the drawings. FIG. 33 is a combination of a view of a link mechanism in this link type punch press and a block diagram showing a conceptual configuration of a control system.

In FIG. 33, a control device 341 controls the whole link type punch press and is composed of a computerized numerical control device and a programmable controller both controlled by the working program (not shown in the drawings). The control device 341 has control means for each axis for driving the elevation and lowering of the ram 6 or controlling the workpiece feeding means 29. One of these control means is ram axis control means 344. The ram axis control means 344 controls the motor 13, which drives the crank shaft of the link mechanism 1. The ram axis control means 344 has motor rotating-direction control means 344 that switches the rotation of the motor 13 between a forward and backward directions, and motor rotating-speed control means 345 for controlling the rotation speed of the motor 13.

The control device 341 has working type selecting means 342. The motor rotating-direction control means 344 switches the rotation of the motor 13 between the forward and backward directions depending on the type of working selected by the working type selecting means 342. The working type selecting means 342 selects a type of punch working quality to provide information indicating that, for example, either normal working or high-quality working has been selected. In this example, it is possible to select one of three levels including the normal working and high-quality working as well as ultra-high-quality working.

The motor rotating-direction control means 344 switches the rotation of the motor 13 between the forward and backward directions depending on the type of working selected by the working type selecting means 342. If the working type selecting means 342 selects the normal working as a type of working, the motor rotating-direction control means 344 sets the rotation of the motor 13 to the forward direction, i.e. the direction in which rotation is transmitted via the link mechanism 1 to make the lowering speed of the ram 6 lower than its elevating speed. The opposite rotating direction is set for the high-quality working. The motor rotating-direction control means 344 also sets the opposite rotating direction if the working type selecting means 342 selects the ultrahigh-quality working.

The motor rotation speed control means 345 is provided with a function of detecting predetermined information to increase the rotation speed of the motor so as to further increase the lowering speed of the ram 6 if the motor rotating-direction control means 344 sets the motor rotating direction in which the lowering speed of the ram 6 is higher than its elevating speed. In controlling the motor to increase its rotation speed so as to further increase the lowering speed of the ram 6, the motor rotation speed control means 345 may increase the speed in all sections corresponding to one rotation of the crank member 2 or in only the ram lowering section during one rotation of the crank member 2. The predetermined information indicates that, for example, the working type selecting means 342 has selected the ultra-high-quality working as a type of working.

Specifically, the working type selecting means 342 may be working type selection information described in the working program, information set in parameter setting means (not shown in the drawings) or the like, or information inputted from the operation panel by an operator. The working type selection information described in the working program may be provided as a command using an NC code or the like or may be attribute information. The type of punch working quality has only to allow the type of punch working quality to be identified. Alternatively, the control device 341 may recognize information on the material of the plate material, the type of surface treatment, and the like as working type selection information and may transmit this information to the motor rotating-direction control means 344.

Figure 34A:
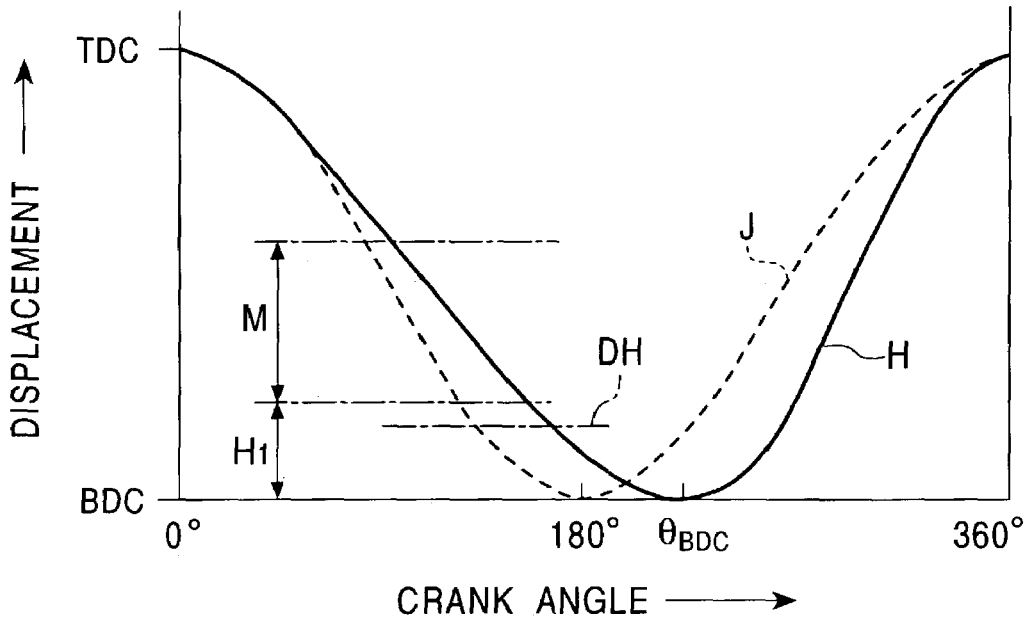
FIGS. 34A and 34B are graphs showing the relationship between the crank angle and ram displacement in this link mechanism at the time when the motor is rotated in the forward and backward directions, respectively.

A description will be given of operations of the control device 341 configured as described. When the working type selecting means 342 selects the normal working, the motor rotating-direction control means 344 rotates the motor 13 in the forward direction. Thus, as previously described with reference to FIG. 34A, the ram 6 operates at a lower speed during lowering than during elevation. This enables punch working with a low torque.

Figure 34B:
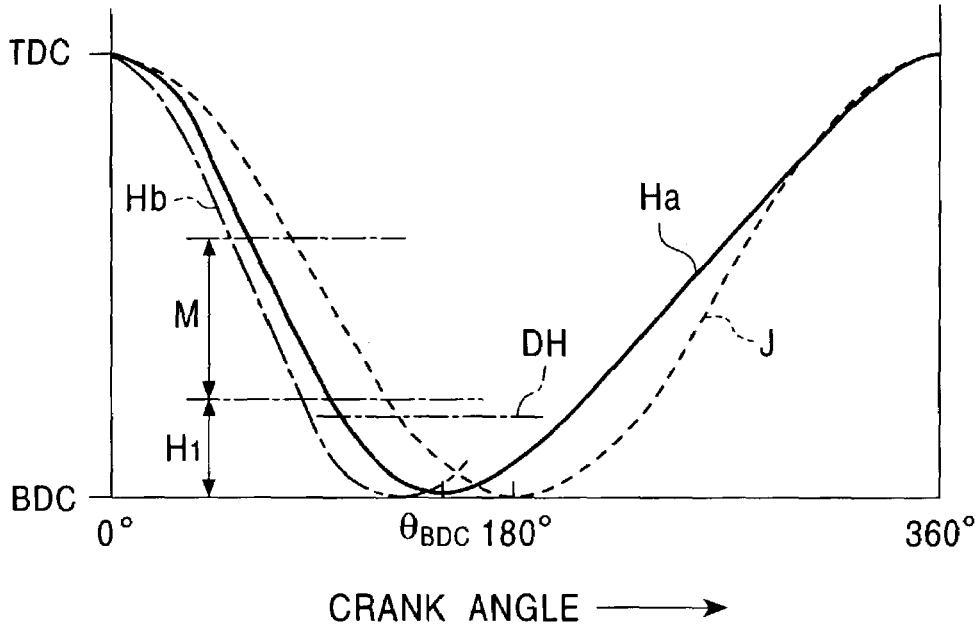

If the working type selecting means 342 selects the high-quality working, the motor rotating-direction control means 344 rotates the motor 13 in the opposite direction. Thus, the lowering speed of the ram 6 is increased as shown by a curve Ha in FIG. 34B. Consequently, high-quality punch working can be accomplished. That is, punch working can be accomplished with few burrs. However, in this case, a heavy press load cannot be obtained, so that a plate material workpiece with a large board thickness cannot be punched. Further, punch working cannot be achieved in which a hole with a large diameter is formed.

It is thus possible to freely select either the normal working, in which a plate material workpiece with a large board thickness can be punched or a hole with a large diameter can be formed, or the high-quality working, which can accomplish high-quality working in spite of limits on the efficiency, board thickness, hole diameter, or the like.

When the working type selecting means 342 selects the ultra-high-quality working, the motor rotating-direction control means 344 rotates the motor 13 in the opposite rotating direction. The motor rotation speed control means 345 increases the rotation speed to further increase the lowering speed of the ram 6. A curve Hb in FIG. 34B indicates a speed curve for the ram 6 in this case.

Thus lowering the ram 6 faster enables higher-quality working. In this case, stricter limits are imposed on the board thickness and the hole diameter. However, if they are within corresponding allowable ranges, higher-quality working can be accomplished.

The motor driven link press of the present invention employs the link mechanism having the crank member, pivoting link, connecting rod, and restraining link. Consequently, even with a motor with relatively low output power, it is possible to carry out working with a heavy press load and improve the working cycle time. Further, even though the link mechanism is employed, the drive-transmitting system that controls the rotation of the motor to controllably transmit the elevating and lowering operations of the ram is employed to transmit rotational driving effected by the motor to the crank shaft of the link mechanism. That is, this drive transmitting system does not include any parts such as a flywheel which are intended to apply inertia. Therefore, this motor drive link press can be properly controlled easily.

If a servomotor is used as this motor, it is possible to freely control the operation speed to accomplish various types of working while making the best of advantages of the link press.

If this motor driven link press is applied to a punch press, when the intermediate section of lowering process of a electing and lowering stroke of the ram is used as that section of elevating and lowering stroke of the ram which is used to punch the plate material workpiece, a sufficient stroke can be provided below the bottom surface of the plate material workpiece. This ensures that punching scraps are dropped.

What is claimed is:

1. A motor driven link press characterized by comprising a motor, a link mechanism that converts rotating operation transmitted by the motor via a drive transmitting system, into a linear operation, and a ram installed below said link mechanism to elevate and lower for press working on the basis of said linear operation, said link mechanism comprising a crank member having a crank shaft and an eccentric shaft portion, a pivoting link having a first to third connecting portions located at vertices of a triangle and which are used for rotatable connections, the first connecting portion being connected to the eccentric shaft portion of said crank member, a connecting rod having opposite ends connected to the second connecting portion and an upper end of said ram, respectively, and a restraining link having a proximal end rotationally movably connected to a frame and a leading end connected to the third connecting portion of said pivoting link, the restraining link restraining pivoting of said pivoting link so that a lowering operation of the ram is slower than an elevating operation of the ram when said crank shaft is rotated at a fixed speed in one direction, said drive transmitting system controlling rotation of the motor to transmit rotational driving effected by said motor to said crank shaft so that an elevating and lowering operations of the ram can be controlled, wherein said motor is a servomotor, and wherein said link press is a punch press, and that section of elevating and lowering stroke of said ram which is used to punch a plate material workpiece is an intermediate section of lowering process of said elevating and lowering stroke.

2. A motor driven link press characterized by comprising a motor, a link mechanism that converts rotating operation transmitted by the motor via a drive transmitting system, into a linear operation, and a ram installed below said link mechanism to elevate and lower for press working on the basis of said linear operation, said link mechanism comprising a crank member having a crank shaft and an eccentric shaft portion, a pivoting link having a first to third connecting portions located at vertices of a triangle and which are used for rotatable connections, the first connecting portion being connected to the eccentric shaft portion of said crank member, a connecting rod having opposite ends connected to the second connecting portion and an upper end of said ram, respectively, and a restraining link having a proximal end rotationally movably connected to a frame and a leading end connected to the third connecting portion of said pivoting link, the restraining link restraining pivoting of said pivoting link so that a lowering operation of the ram is slower than an elevating operation of the ram when said crank shaft is rotated at a fixed speed in one direction, said drive transmitting system controlling rotation of the motor to transmit rotational driving effected by said motor to said crank shaft so that an elevating and lowering operations of the ram can be controlled, and wherein said link press is a punch press, and that section of elevating and lowering stroke of said ram which is used to punch a plate material workpiece is an intermediate section of lowering process of said elevating and lowering stroke.

* * * * *